US006641965B2

(12) United States Patent
Nakamura et al.

(10) Patent No.: US 6,641,965 B2
(45) Date of Patent: Nov. 4, 2003

(54) COLOR TONER FOR ELECTROPHOTOGRAPHY, AND A COMBINED SET OF COLOR TONERS FOR ELECTROPHOTOGRAPHY USING THE SAME, COLOR DEVELOPING AGENT FOR ELECTROPHOTOGRAPHY USING THE SAME, METHOD FOR FORMING COLOR IMAGES USING THE SAME, AND DEVICE FOR FORMING COLOR IMAGES USING THE SAME

(75) Inventors: Yasushige Nakamura, Kawasaki (JP); Tomoaki Tanaka, Kawasaki (JP); Yoshimichi Katagiri, Kawasaki (JP); Masae Nakamura, Kawasaki (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 28 days.

(21) Appl. No.: 10/103,558

(22) Filed: Mar. 22, 2002

(65) Prior Publication Data

US 2003/0134214 A1 Jul. 17, 2003

(30) Foreign Application Priority Data

Dec. 14, 2001 (JP) ..... 2001-380999

(51) Int. Cl.[7] ..... G03G 9/09

(52) U.S. Cl. ..... 430/107.1; 430/108.1; 430/111.4; 399/252; 399/321

(58) Field of Search ..... 430/107.1, 108.1, 430/111.4; 399/252, 321

(56) References Cited

U.S. PATENT DOCUMENTS

2003/0036011 A1 * 2/2003 Ebisu et al. ..... 430/108.1

FOREIGN PATENT DOCUMENTS

| | | |
|---|---|---|
| JP | 3-126043 | 5/1991 |
| JP | 2000-330333 | 11/2000 |

* cited by examiner

*Primary Examiner*—Mark A. Chapman
(74) *Attorney, Agent, or Firm*—Armstrong, Westerman & Hattori, LLP

(57) ABSTRACT

A color toner for electrophotography, preferably used as a flash fixing toner which can be processed at a high speed, and exhibit excellent fixing property, high image resolution (image reproducibility) when fixed, and color reproducibility by color overlapping, and having a preferable color tone, with which a multi-color image can be formed. The color toner for electrophotography is used for the extreme bottom layer of a multi-color image comprised of laminating at least two types of toners that are selected from black toner, magenta toner, yellow toner, and cyan toner, and contains a coloring agent and an infrared ray absorbent, the color toner for electrophotography has a contrast ratio in the range of 35% to 95%.

20 Claims, 10 Drawing Sheets

Contrast ratio and effects thereof

Color Reproducibility (Color Region)

Contrast ratio and effects thereof

Coloring Agent Variations of different particle diameters and Contrast Ratio

Relationship between flash energy and fixing ratio

Where fixing is executed color by color

Color gamuts of Conventional art toners

Color gamuts of conventional art colors

COLOR TONER FOR ELECTROPHOTOGRAPHY, AND A COMBINED SET OF COLOR TONERS FOR ELECTROPHOTOGRAPHY USING THE SAME, COLOR DEVELOPING AGENT FOR ELECTROPHOTOGRAPHY USING THE SAME, METHOD FOR FORMING COLOR IMAGES USING THE SAME, AND DEVICE FOR FORMING COLOR IMAGES USING THE SAME

BACKGROUND OF THE INVENTION

1. Field of the Invention

The present invention relates to a color toner for electrophotography, which is preferable as a toner for flash fixing and is able to form multi-color images, a combined set of color toners for electrophotography for forming multi-color images, in which several types of the corresponding color toner for electrophotography are combined, a color developing agent capable of forming multi-color images, which includes the corresponding color toner for electrophotography, a method and an apparatus for forming multi-color images, which use the corresponding color toner for electrophotography and are easily capable of forming multi-color images.

2. Description of the Related Art

In forming an image by electrophotography, generally, an electrostatic latent image carrier (which may be called a "photo conductor") is electrically charged to expose the corresponding electrostatic latent image carrier, thereby forming an electrostatic latent image. And, toner is adhered to the corresponding electrostatic latent image and is developed, thereby forming a visible image by a toner image. After the visible image brought about by the toner image is transferred onto a recording medium, it is fixed to form a fixed image on the recording medium There are some fixing methods with respect to the fixing, one of which is a fusion fixing method by which toner for forming the visible image is solidified and fixed after the same is melted by compression and/or heating, and another of which is a flash fixing method by which toner for forming the visible image is solidified and fixed after the same is melted by irradiating light energy, etc.

Of these, the flash fixing method has been recently focused since the method has advantages in comparison with the fusion fixing method. That is, since the flash fixing method does not need any compression of the toner by bringing the toner in contact with a fixing roller, the image resolution (image reproducibility) is not deteriorated in fixing. Further, it is not necessary that the toner is heated and melted by a high temperature heating source, or the like since no high temperature heating source is required, it is possible to adequately prevent the inside temperature of an image forming apparatus from being increased, and even if recording paper is clogged in a fixing unit due to a cause of system failure, no concern is necessary for the recording paper to be ignited by the heat from the high temperature heating source. In addition, such a problem as fixing is not performed until a fixing roller reaches to a prescribed temperature does not exist, and thereby high-speed fixing is possible. Hence, various advantages may be earned.

However, in the case of the flash fixing method, although black toner having a high photoadsorption ratio has a satisfying fixing property, there is another problem in that the fixing property of color toner having a lower photoadsorption ratio is not necessarily sufficient.

Therefore, proposals for improving the fixing property by the flash fixing method in the corresponding color toner by doping an infrared ray absorbing agent to the color toner have been provided in patent publications for example in Japanese Patent Application Laid-Open Nos. 1985-63545, 1985-63546, 1985-57858, 1985-057857, 1983-102248, 1983-102247, 1985-131544, 1985-133460, 1986-132959, WO99/13382, 2000-147824, 1995-191492, 2000-155439, 1999-38666, 1999-125930, 1999-125928, 1999-125929, and 1999-65167, etc., However, as infrared ray absorbents that are doped to the color toner, for example, aminium-based, diimonium-based, and cyanine-based infrared ray absorbents (presenting light green color), polymetin-based, nickel complex-based infrared ray absorbents (presenting light brown color), a part of a cyanine-based infrared ray absorbent (presenting gray color), and lanthanoid-based infrared ray absorbent represented by tin oxide, ytterbium oxide, etc., (presenting white color), etc., have been publicly known. Of these, since a lanthanoid-based infrared ray absorbent displaying white has low infrared ray absorption power, the same absorbent cannot be used independently, for such reason, it is necessary that a colored infrared ray absorbent may be used along with the same lanthanoid-based infrared ray absorbent or the colored infrared ray absorbent may be used independently.

However, in a case in which a colored infrared ray absorbent is doped to the corresponding color toner that is used to form a color image expressing an optical color by laminating three types of color toner consisting of three prime colors, which are yellow toner, magenta toner and cyan toner, there is a serious problem in that the expression area of the color of the corresponding color toner is remarkably narrowed. That is, as shown in FIG. 11 and FIG. 12, (also, in these drawings, an "INFRARED" means an infrared ray absorbent), where [L*], [a*], and [b*] (these indicate measurement values in compliance with the method for indicating object colors, which are regulated in Japanese Industrial Standards No. JIS Z 8729) in the publicly known three prime color toners, that is, yellow toner, magenta toner and cyan toner (each of which does not include any infrared ray absorbent) are compared with [L*], [a*], and [b*] in infrared ray absorbent-contained color toner, in which a colored infrared ray absorbent (Naphthalocyanine compound) is doped to each of the corresponding three prime color toners, the [L*i], [a*], and [b*] values of the corresponding infrared ray absorbent-contained color toner are narrowed due to influences of the infrared ray absorbent, wherein the brightness and chroma, etc., are narrowed, and the light transmission property is lowered. In this case, another problem arises in that the color becomes muddy.

Therefore, high performance color toners for electrophotography, which utilize the advantages in color toners and can solve the other problems, have not been developed until the present. There is a strong expectation for the production of such color toners for electrophotography

SUMMARY OF THE INVENTION

The present invention is to overcome the problems of the conventional arts and to meet requirements mentioned above. It is therefore an object of the present invention to provide a color toner for electrophotography, with which multi-color images can be formed, preferable as a flash fixing toner having an excellent fixing property, an excellent image resolution (image reproducibility) when fixed, an excellent color reproducibility in color overlapping, and exhibits excellent color tone, and meets high speed processing requirement; a combined set of color toners for electrophotography for forming multi-color images, in which a combination of the color toners for electrophotography is employed; a color developing agent containing the color toners for electrophotography, which is able to easily form high-quality multi-color images; and a method and an apparatus for forming color images, which are able to easily form high-quality multi-color images, using the color toner.

A color toner for electrophotography according to the present invention is used on the extreme bottom layer of a multi-color image which is comprised of laminating at least two types of toner selected from black toner, magenta toner, yellow toner, and cyan toner, and contains a coloring agent and an infrared ray absorbent, and whose contrast ratio is in the range of 35% to 95%. If the color toner for electrophotography is used for an fixing process utilizing light, high speed processing is enabled, and if the same is used on the extreme bottom layer in a multi-color image comprised by laminating color toners, do not affect color toners that are used on layers other than the extreme bottom layer. Further, the fixing property, image resolution (image reproducibility) at the time of fixing, and color reproducibility in color overlapping are excellent, and exhibit satisfying color tone.

A combined set of color toners for electrophotography according to the present invention is used to form a multi-color image comprised by laminating toners comprised of at least two types of color toners selected from black toner, magenta toner, yellow toner, and cyan toner, wherein at least one of the two types of toners which may be defined as toner A is used on the extreme bottom of the multi-color image and is selected from the magenta toner, yellow toner and cyan toner, and further contains a coloring agent and an infrared ray absorbent, and the contrast ratio thereof is 35% to 95%. In addition, the other toners used on layers other than the extreme bottom layer of the multi-color image which may be defined as toner B, are comprised of coloring agent and an infrared ray absorbent, and the contrast ratios thereof are 20% to 50%. If the combined set of color toners for electrophotography is used for a flash fixing process, high-speed processing is possible, and if one of the toners is used on the extreme bottom layer in a multi-color image and the other toners are used on layers excluding the extreme bottom layer, since the toners do not adversely affect each other, a high-quality image could be obtained in which the fixing property, image resolution (image reproducibility) in fixing, and color reproducibility in color overlapping are excellent, and exhibits satisfying color tone.

A color developing agent for electrophotography according to the present invention contains at least a color toner for electrophotography according to the present invention. If the color developing agent for electrophotography is used, the fixing property, image resolution (image reproducibility) in fixing, and color reproducibility in color overlapping are excellent, and satisfying color tone. Also, if the color developing agent for electrophotography is used for a flash fixing process, high-speed processing is possible.

A method for forming color images according to the present invention uses a color toner for electrophotography comprised of at least two types of color toners, which are selected from black toner, magenta toner, yellow toner and cyan toner, and at least one of these contains an infrared ray absorbent, in which one type selected from the magenta toner, yellow toner and cyan color is a color toner for the extreme bottom layer, having a contrast ratio in the range of 35% to 95%, and the method further comprises the steps of:

forming an electrostatic latent image on an electrostatic latent image carrier;

developing the above electrostatic latent image by using the color toner for the extreme bottom layer, forming a visible image on the extreme bottom layer by the color toner for the extreme bottom layer, further developing the electrostatic latent image by using a color toner for an upper layer other than the color toner for the extreme bottom layer in the color toners for electrophotography, and forming a visible image on the upper layer by the color toner for the upper layer;

transferring the visible image on the extreme bottom layer and the visible image on the upper layer onto a recording medium with the visible image on the extreme bottom layer placed on the extreme bottom layer, and forming a combined transferred image; and transferring the combined transferred image onto the recording medium and flash fixing the transferred image.

In the image forming method, an electrostatic latent image is formed on an electrostatic latent image carrier in the step for forming an electrostatic latent image. In the developing step, the electrostatic latent image is developed by the color toner for the extreme bottom layer, and an visible image on the extreme bottom layer is formed by the corresponding color toner for extreme bottom layer. The electrostatic latent image is developed by using an toner for upper layer other than the color toner for extreme bottom layer in the color toners for electrophotography, and an visible image on the upper layer is formed by the corresponding toner for upper layer. In the transferring step, the visible image on the extreme bottom layer and the visible image on the upper layer are transferred onto a recording medium with the visible image on the extreme bottom layer placed on the extreme bottom, and a combined transferred image is formed. In the flash fixing step, the combined transferred image is transferred onto the recording medium, wherein the transferred image is optically fixed. As a result, a high-quality image having excellent image resolution (image reproducibility) and excellent color reproduction by color overlapping, a satisfying color tone may be efficiently formed.

A color image forming apparatus according to the present invention comprises: an electrostatic latent image carrier;

means for forming an electrostatic latent image on the corresponding electrostatic latent image carrier;

means for forming a visible image on the extreme bottom layer by developing the electrostatic latent image using a color toner for extreme bottom layer which is a color toner for electrophotography, comprised of at least two types selected from black toner, magenta toner, yellow toner, and cyan toner, in which one of the two color toners contains an infrared ray absorbent, and another one is selected from the magenta toner, yellow toner and cyan toner, and the contrast ratio thereof is 35% to 95%, and means for forming a visible image on the upper layer by developing the electrostatic latent image using an toner for upper layer other than the color toner for extreme bottom layer in the color toners for electrophotography;

means for transferring the visible image on the extreme bottom layer and the visible image on the upper layer onto a recording medium with the corresponding visible image on the extreme bottom layer placed on the extreme bottom layer, and for forming a combined transferred image; and means for flash fixing the combined transferred image transferred on the recording medium.

In the apparatus for forming color images, the means for forming an electrostatic latent image forms an electrostatic latent image on an electrostatic latent image carrier. The means for developing the extreme bottom layer in the developing means develops the electrostatic latent image by using the color toner for extreme bottom layer and forms a visible image on the extreme bottom layer. The means for developing an upper layer develops the latent image by using an toner for upper layer and forms the visible image on the upper layer. The transferring means transfers the visible image on the extreme bottom layer and visible image on the upper layer onto a recording medium with the corresponding visible image on the extreme bottom layer placed on the extreme bottom layer and forms a combined transferred image. The flash fixing means flash fixes the combined image transferred on the recording medium. Consequently, a high-quality image that has excellent image resolution (image reproducibility) and color reproducibility in color overlapping and satisfying color tone can be efficiently formed on the corresponding recording medium.

Figure 1:
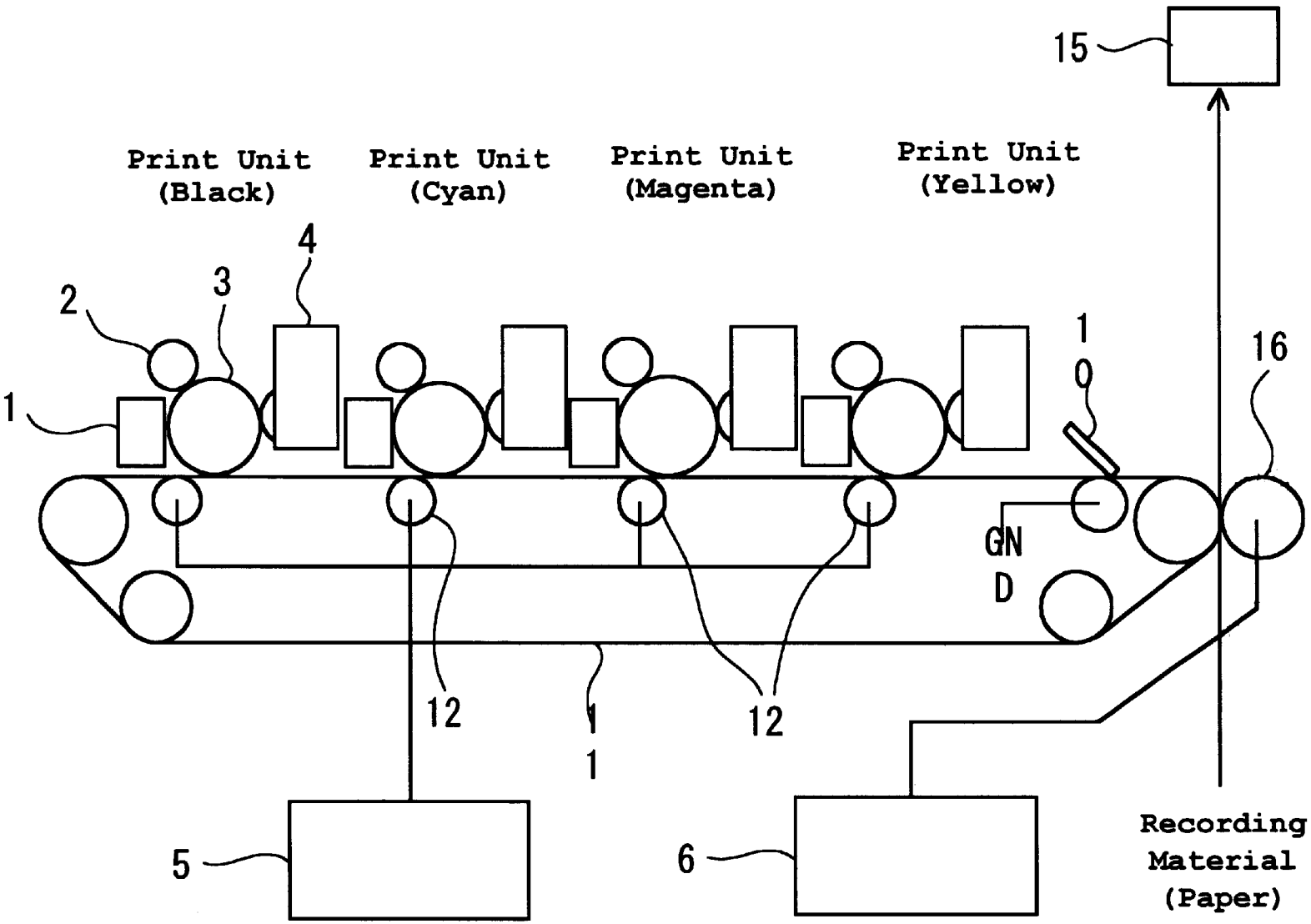
FIG. 1 is a view for explaining one example of a method for forming color images of the present invention, to which an apparatus for forming color images of the invention is applied.

DESCRIPTION OF THE PREFERRED EMBOIMENTS (Color Tone for Electrophotography)

Color toner for electrophotography according to the present invention is a toner used to form multi-color images comprised of laminating at least two types of toners selected from black toner, magenta toner, yellow toner and cyan toner, and the same color toner is divided into two types, one of which is the color toner for extreme bottom layer defined as toner A used for the extreme bottom layer in the corresponding multi-color images, and the other of which is an toner for upper layer defined as toner B used for layers other than the extreme bottom layer.

Color Toner for Extreme Bottom Layer

The above color toner for extreme bottom layer is one that is selected from magenta toner, yellow toner, and cyan toner. Any one of these may be selected. However, since color toner has the color tone thereof easily influenced by an infrared ray absorbent, it is preferable that a color toner having the largest color tone difference (ΔE) described later be selected. Generally, since the colors presented by the infrared ray absorbent are green (aminium, diimonium, cyanine-based infrared ray absorbent, etc.), and brown (nickel complex-based infrared ray absorbent, etc.) in many cases, the color tone difference (ΔE) is made larger in the magenta toner and yellow toner that have larger chroma than the cyan toner. Therefore, magenta toner and yellow toner may be preferably used as the extreme bottom layer toner.

The color toner for extreme bottom layer contains a coloring agent and an infrared ray absorbent, and may contain a bonding resin, a charge control agent, and other constituents, which are suitably selected as necessary.

It is necessary that the contrast ratio of the color toner for extreme bottom layer be 35% to 95%, of which 40% to 95% is preferable, and 55% to 80% is more preferable.

Influence of coloring due to an infrared ray absorbent is suppressed if the contrast ratio in the color toner for extreme bottom layer is within the above numerical range, wherein a favorable hue of a coloring agent itself can be retained.

The contrast ratio can be calculated as described below. That is, the color toner for extreme bottom layer is blended with a solvent, and dissolved and dispersed by a paint shaker. The toner solution thus produced is coated onto white paper (whose reflectivity is 80±1) and black paper (whose reflectivity is 2 or less), both of which are regulated in Japanese Industrial Standards JIS K5101, by using a No.16 bar coater, and is then dried to produce samples. The brightness of the samples thus obtained is measured by a spectrometer (938 Spectrodentitometer manufactured by X-RITE Corp.), wherein the contrast ratio can be calculated by the following expression (1):

$$\text{Contrast ratio } (\%) = (LB/LW) \times 100.$$

Also, a visible evaluation is regulated in JIS K5101. However, a numerical evaluation is employed in the present invention, and in the expression (1), [LB] indicates the brightness on the black paper, and [LW] indicates that on the white paper.

With respect to the contrast ratio, there is the following relationship between the coloring agent and the contrasting property. That is, if the contrasting property is high due to the coloring agent, the brightness on the black paper is increased while the brightness on the white paper is decreased, wherein the contrast ratio is accordingly increased. To the contrary, if the contrasting property is decreased due to the coloring agent, the brightness on the black paper is lowered as the influence of the black paper is increased, wherein the brightness on the white paper is increased, and the contrast ratio is lowered.

It is preferable that the average particle diameter of the primary particles of the coloring agent be within a prescribed numeric range due to the relationship with the contrast ratio. To be specific, it is preferable that the average particle diameter of the primary particles be 100 nm or more, more preferably be 200 to 500 nm, and particularly preferably be 230 to 400 nm.

If the average particle diameter of primary particles of the coloring agent is 100 nm or more, the contrast ratio can be kept high, since the color tone difference caused by the infrared ray absorbent can be decreased, and it is possible to obtain high-quality color toner for the extreme bottom layer, which has an excellent color tone.

However, if the ratio of content of the coloring agent is increased even though the average particle diameter of the primary particles of the coloring agent is less than 100 nm, there is a possibility for the contrast ratio to be increased. However, if the diameter of the particle for the coloring agent is too small, a large amount needs to be contained in the color toner for the extreme bottom layer, otherwise adversely affect intrinsic color forming property of the coloring agent.

The average particle diameter of the primary particles of the coloring agent can be obtained by [Diameter equivalent to Ferre's Circle]. That is, the color toner particles for the extreme bottom layer, which are frozen by liquid nitrogen are cut by a microtome to produce ultra-thin sections of the toner. A TEM photograph (magnification power 50,000 times) is taken on the ultra-thin sections of toner, and the image of the TEM photograph is read by a dot analyzer DA-5000S (Ohji Instrument Co., Ltd.). Next, the [Diameter equivalent to the Ferre's Circle] is read from the TEM photograph by the same dot analyzer. The measuring operation is repeated to cover 10 grains of the toner (equivalent to 200 particles of the coloring agent particles), and the average value is then obtained. The average value can be calculated and taken out as the average particle diameter of the primary particles. The [Diameter equivalent to the Ferre's Circle] is a manner to define a solid particle size, and an average of the diameter of a projecting particle can be obtained by measuring the projecting particle at eight angles (0, 22.5, 45, 67.5, 90, −22.5, −45, and −67.5).

It is preferable that the color tone difference in the color toner for extreme bottom layer be 10 or less in terms of securing a satisfying color tone, and more preferably be 8 or less.

The color tone difference ($\Delta E$) is expressed in terms of a difference ($E_0$–$E_1$) between the color tone ($E_1$) where the color toner for extreme bottom layer contains the above infrared ray absorbent and the color tone ($E_0$) where the color toner for extreme bottom layer does not contain the infrared ray absorbent.

The color tone difference ($\Delta E$) can be calculated as described below. That is, using a spectrometer (938 Spectrodentitometer manufactured by X-RITE Corp.), a toner image is adhered on a recording medium (paper, etc.) by using the color toner for extreme bottom layer at a ratio of 0.4 to 0.8 mg per square centimeter, wherein with respect to a case where the infrared ray absorbent is contained, and a case where the infrared ray absorbent is not contained, values of [L*], [a*] and [b*] are measured in compliance with the method for indicating object colors according to JIS Z8729 after the toner image is fixed, in order to calculate the color tone difference.

In view of controlling the contrast ratio to be in the above mentioned numeric range, it is preferable that the ratio of content of the coloring agent in the color toner for extreme bottom layer be 3% to 15% by weight, more preferably 5% to 10% by weight.

There may be cases where if the ratio of content of the coloring agent exceeds 15% by weight in the color toner for extreme bottom layer, the fixing property of the corresponding color toner for extreme bottom layer is worsened while the contrast ratio is improved. And, if the ratio of content thereof is less than 5% by weight, sufficient chroma saturation may not be obtained.

Therefore, in order to control the contrast ratio in the color toner for extreme bottom layer within the numeric range, it is effective to adjust the average particle diameter of primary particles of the coloring agent and the ratio of content thereof.

In order to maintain the color tone to be the same as that of the general color toner and preventing turbidity or cloudiness of the colors, it is preferable that the color toner for extreme bottom layer contain a white coloring agent. Also, it is preferable that the ratio of content thereof ibe 10% by weight or less, more preferably 5% by weight or less.

If the ratio of content of the white coloring agent is 10% by weight or less, the value of [L*] can be increased without lowering the values [a*] and [b*].

As the white coloring agent, for example, titanium oxide, silica, alumina, tin oxide, barium titanate, strontium titanate, bismuth stannate, and ytterbium oxide, etc., may be mentioned.

These may be used alone, or two or more may be combined for use. Of these, ytterbium oxide is preferable since it has a function as the infrared ray absorbent.

The color toner for extreme bottom layer may be preferably used as a flash fixing toner, and if laminated with the toner for upper layer and used for formation of multi-color images, it is possible to efficiently form a high-quality image having excellent resolution (image reproducibility), an excellent color reproducibility in color overlapping, and satisfying color tone.

Toner for Upper Layer

The toner for upper layer is used in combination with the color toner for extreme bottom layer, and is one or two types selected from black toner, magenta color, yellow color, and cyan toner and may be selected from toners other than the toner selected for the color toner for extreme bottom layer. However, generally, the cyan toner may be preferably mentioned because it is not subjected to fluctuations in color tone due to the infrared ray absorbent.

The toner for upper layer contains a coloring agent and an infrared ray absorbent as in the color toner for extreme bottom layer. And the toner for upper layer may contain a bonding resin, a charge control agent, and other constituents, which are suitably selected as necessary.

It is preferable that the contrast ratio of the toner for upper layer be 20% to 50%, more preferably be 30% to 50%, and particularly preferably be 40 to 50%.

If the contrast ratio of the toner for upper layer exceeds 50%, there is a possibility for the color tone of the color toner for extreme bottom layer to be masked where the toner for upper layer is laminated with the corresponding color toner for extreme bottom layer and an image is thus formed, wherein there is a limitation in expressing a multi-color through full color image. In addition, if the contrast ratio of the toner for upper layer is less than 20%, it becomes impossible to suppress influences due to coloring by the above-infrared ray absorbent in the second and third color through color overlapping, wherein there may be cases where the color reproducibility cannot be obtained in flash fixing.

It is preferable that the average particle diameter of the primary particles of the coloring agent be within an prescribed numeric range in terms of the contrast ratio. In detail, it is preferable that the corresponding average particle diameter of the primary particles be 200 nm or less, more preferably be 100 nm to 200 nm.

If the average particle diameter of the primary particles of the coloring agent exceeds 200 nm, the contrast ratio is increased. Where the coloring agent is laminated with the extreme bottom color toner and a multi-color image is thus formed, the color tone of a subtractive color mixture with the corresponding color toner for extreme bottom layer may be worsened, and if the average particle diameter is less than 100 nm, influences due to the infrared ray absorbent are increased, and there may be a case where color of the toner for upper layer is subjected to turbidity or cloudiness.

It is preferable that the color tone difference in the toner for upper layer be 10 or less in view of securing a satisfying color tone, more preferably be 8 or less.

The color tone difference ($\Delta E$) is expressed in terms of a difference ($E_0$–$E_1$) between the color tone ($E_1$) where the toner for upper layer contains the above infrared ray absorbent and the color tone ($E_0$) where the toner for upper layer does not contain the infrared ray absorbent.

In view that the contrast ratio is controlled to be within the numeric range, it is preferable that the ratio of content of the coloring agent in the toner for upper layer be 0.1% to 20% by weight, more preferably be 0.5% to 10% by weight.

There may be cases where, if the ratio of content of the coloring agent exceeds 20% by weight in the toner for upper layer, the fixing property of the corresponding toner for upper layer is worsened while the contrast ratio is improved. And, if the ratio of content thereof is less than 0.1% by weight, sufficient chroma saturation may not be obtained.

Therefore, in view of controlling the contrast ratio in the toner for upper layer within the numeric range, it is effective to adjust the average particle diameter of primary particles of the coloring agent and the ratio of content thereof.

In view of maintaining the color tone that is the same as that of the general color toner and preventing turbidity or cloudiness of the colors, it is preferable that the toner for upper layer contains a white coloring agent. Also, it is preferable that the ratio of content thereof ibe 10% by weight or less.

The toner for upper layer may be preferably used as a flash fixing toner. If the toner for upper layer is laminated with the color toner for extreme bottom layer and a multicolor image is thus formed, it is possible to efficiently form a high-quality image having excellent image resolution (image reproducibility) and an excellent color reproducibility in color overlapping, and satisfying color tone.

Coloring Agent

There is no particular restriction as for the coloring agent in color toner for electrophotography of the present invention, and is possible to suitably select a coloring agent according to an object from various coloring agents that are publicly known. For example, carbon black, lamp black, black iron oxide, ultramarine blue pigment, nigrosin dye, aniline blue, chako oil blue, DuPont oil red, quinoline yellow, methylene blue chloride, phthalocyanine blue, phthalocyanine green, hanza yellow, rhodamine 6 C rake, chrome yellow, quinachridon, benzidine yellow, malachite green, malachite green hexalate, oil black, azo oil black, rose bengal, monoazo-based pigment, disazo-based pigment, trisazo-based pigment, etc., may be mentioned.

These may be used alone, or in combination of two or more agents may be used concurrently.

Infrared Ray Absorbent

The infrared ray absorbent according to color toner for electrophotography according to the present invention may be comprised of a material having at least one or more intensive photoadsorption peaks around the near infrared ray area around 750 to 1200 nm. The absorbent may be either of an inorganic infrared ray agent or an organic infrared ray absorbent.

For example, lanthanoid compounds such as ytterbium oxide, ytterbium phosphate, etc., indium tin oxide, tin oxide, etc., may be mentioned as the inorganic infrared ray absorbents.

For example, aminium compounds, diimonium compounds, naphthalocyanine-based compounds, cyanine-based compounds, polymetin-based compounds, etc., may be mentioned as the organic infrared ray absorbents.

These compounds may be used alone or in combination of two or more may be used concurrently.

Bonding Resin

There is no particular restriction for the Bonding resin in color toner for electrophotography according to the present invention. The bonding resin may be suitably selected according to an object. For example, thermoplastic resins such as natural macromolecules, synthetic macromolecules, etc., may be mentioned. In detail, styrene-acrylic resin, epoxy resin, polyether polyol resin, polyester resin, cycloolefin resin such as polyethylene, polypropyrene, etc., polyacrylic resin, polyamide resin, polyvinyl resin, polyurethane resin, polybutadiene resin, etc., may be favorably used. Besides, wax such as ester wax, Carunauba wax, Fischer-Tropsch wax, parafin wax, rice wax, etc., may be mentioned.

These may be used alone or in combination of two or more types of wax may be used. Of these, it is preferable in view of suppressing odor in performing flash fixing that polyester resin used alone, or with other bonding resins.

No particular restriction exists with respect to the bonding resin. It may be suitably selected according to an object. It is preferable that the average molecular weight be 4,000 to 100,000, and the melting point is 90 to 150° C.

There is no limitation in the ratio of content of the bonding resin in the color toner for electrophotography. However, it is preferable that the ratio of content thereof be 50% by weight in view of fixing, more preferably be 70% by weight to 95% by weight.

Charge Control Agent

There is no particular restriction for the charge control agent in color toner for electrophotography according to the present invention, and a charge control agent may be suitably selected from the charge control agents that have been publicly known, according to an object. However, for example, calixarene, nigrosin-based dyes, quartemary ammonium salt, amino group-contained polymer, metal-contained azo dyes, salicylic acid chelate compounds, phenol compounds, azochrome-based compounds, azo zinc-based compounds, triphenyl methane derivatives, naphthoya acid zinc chelate, etc., may be mentioned.

These may be used alone or in combination of two or more types may be concurrently used.

Other Constituents

There are no particular restriction for the other constituents in color toner for electrophotography according to the present invention, and the constituent may be suitably selected from the constituents that have been publicly known. For example, a fluidity improving agent, cleaning active agent, a fixing assisting agent, wax, metal soap, surface active agent, etc., may be mentioned.

There is no particular limitation for the fluidity improving agent. A fluidity improving agent may be suitably selected from agents that have been publicly known. For example, inorganic particles such as white grains may be mentioned.

For example, silica fine particles, alumina, titanium oxide, barium titanate, magnesium titanate, calcium titanate, strontium titanate, zinc oxide, quartz sand, mica, woodstone, diamaceous earth, chrome oxide, cerium oxide, red ocher, antimony trioxide, magnesium oxide, zirconium oxide, barium sulphate, barium carbonate, calcium carbonate, silicon carbide, silicon nitride, etc., may be mentioned.

These may be used alone or in combination of two or more types. Of these, silica fine particles are preferably used.

Silica fine particles, titanium compounds, resin particles, and alumina, etc., may be concurrently used.

It is preferable that the ratio of content of the fluidity improving agent in the color toner for electrophotography be 0.01% to 5% by weight, more preferably be 0.01% to 2.0% by weight.

There is no particular limitation for the cleaning active agent, and a cleaning active agent may be suitably selected from agents that have been publicly known. For example, metal salt of high-quality fatty acids represented by zinc stearate, etc., particles of fluorine macromolecular body, etc., may be mentioned.

There is no particular limitation for the magnetizing material, and a magnetizing material may be suitably selected from magnetizing materials that have been publicly known. For example, iron powder, magnetite, ferrite, etc., may be mentioned.

In addition, for example, wax, metal soap, surface active agent, etc., may be mentioned as the fixing assisting agent.

As the wax, for example, polypropyrene wax, polyethylene wax, Carunauba wax, ester wax, etc., may be mentioned.

As the metal soup, for example, zinc stearate, etc., may be mentioned.

As the surface active agent, for example, non-ion surface active agent, etc., may be mentioned.

Production of Color Toner for Electrophotography

There is no particular limitation for a method for producing the color toner for electrophotography, and the method may be suitably selected from methods publicly known, according to an object. For example, a mechanical crushing method may be employed, in which, after the coloring agent, the infrared ray absorbent, the bonding resin, the charge control agent, the other constituents are mixed by a mixing apparatus such as a Henschell mixer, these constituents are melted and blended by a blending apparatus (two-axis blending apparatus, for example, PCM-45 manufactured by Ikegai Corp.) and are crushed by crushing apparatus such as a jet mill in order to classify the crushed particles into an prescribed particle size, a spray drying method may be employed, in which the respective constituents are mixed and dispersed in a solvent and sprayed by spray drying, thereby producing particles. Further, a micro capsulation method, a polymerization method, or a hetero agrregation method may be also employed, in which the respective constituents are hetero-aggregated in a water solution containing a surface active agent.

The color toner for electrophotography according to the present invention may be favorably used in a color developing agent for electrophotography, and for a method and an apparatus for forming images by an electrophotographic system. The color toner for electrophotography may be particularly preferably used in the following combined set of color toners for electrophotography, color developing agent for electrophotography, and for the following method and apparatus for forming color images according to the present invention.

(A Set of Color Toners for Electrophotography)

A combined set of color toners for electrophotography according to the present invention is toners comprising at least two types of toner, which are selected from black toner, magenta toner, yellow toner, and cyan toner, wherein it is necessary that at least one of the two is a color toner for the extreme bottom layer of the combined set of color toners for electrophotography according to the present invention, and it is preferable that one of the remaining types of toner be a color toner for an upper layer of combined set of color toners for electrophotography according to the present invention, it is more preferable that all of the other remaining types of combined set of color toners are the toner for upper layer of the combined set of color toners for electrophotography according to the present invention (In this case, the four colors of combined set of color toners consist of the color toner for extreme bottom layer and the toner for upper layer).

The combined set of color toners for electrophotography according to the present invention may be toners comprising at least two or three colors of black toner, magenta toner, yellow toner and cyan toner or may be a full four-color set. Also, in a combined set of color toners for electrophotography according to the present invention, it is preferable that toners of respective colors are, respectively, accommodated in respective toner bottles.

(Color Developing Agent for Electrophotography)

The color developing agent for electrophotography according to the present invention contains at least the color toners for electrophotography according to the present invention, and may be comprised so as to contain constituents suitably selected.

The color developing agent for electrophotography may be a one-constituent developing agent cmoprising the color toners for electrophotography or may be a two-constituent developing agent including the color toners for electrophotography and a carrier. However, where the developing agent is used for a high-speed printer that matches an increase in a recent information processing rate, the two-constituent developing agent is preferable in view of improvements in the service life thereof.

An embodiment of the color developing agent for electrophotography according to the present invention may be any one of a single-color embodiment in which the color developing agent contains at least the color toner for extreme bottom layer of the color toners for electrophotography according to the present invention, and contains other constituents which are suitably selected; a two-color or three-color embodiment in which the color developing agent contains at least the color toner for extreme bottom layer and the toner for upper layer and further contains other constituents which are suitably selected; and a full four-color embodiment in which the color developing agent contains the color toner for extreme bottom layer and three types of the toner for upper layers in the color toners for electrophotography according to the present invention and further contains other constituents which are suitably selected. In the two or three-color embodiment and the full four-color embodiment, the color toners for electrophotography according to the present invention can be preferably used as the combined set of color toners for electrophotography.

Carrier

There is no particular limitation for the carrier, and a carrier may be suitably selected according to an object. Such a type is preferable, which has a core material and a resin layer to cover the core material.

The material for the core material can be selected from manganese-strontium (Mn—Sr) materials of 50–90 emu/g, manganese-magnesium (Mn—Mg) materials, etc., are preferable; from the standpoint of securing image density, however, high magnetizing materials such as iron powder (100 emu/g or higher) and magnetite (75–120 emu/g) are preferable, while weak magnetizing materials such as copper-zinc (Cu—Zn) (30–80 emu/g) are preferable from the standpoint for aiming higher grade images by means of softening the contacts of the toner to the photoconductor where the toner is standing. These materials can be used alone or as a mixture of more than two kinds of materials.

It is preferable that the particle size of the core material be 10 to 150 μm for an average particle diameter (cubic average particle diameter $D_{50}$)), more preferably be 40 to 100 μm.

If the average particle diameter (cubic average particle diameter ($D_{50}$)) is less than 10 μm, the fine powder section is increased in the distribution of carrier particles to cause the magnetization per particle to become weak, wherein the carriers may be splashed. To the contrary, if the average particle diameter exceeds 150 μm, the specific surface area is decreased, wherein toner may be splashed. In the case of full color having many thick portions, particularly, reproduction of the thick portions may be worsened.

There is no limitation in the resin layer. It is possible to adequately select a material from those, which have been publicly known, according to an object. In view of durability and lengthening the service life, for example, silicone resins such as silicone resin, acrylic denatured silicone resin, fluorine denatured silicone resin, etc., may be preferably mentioned. These materials can be used alone or as a mixture of more than two kinds of materials.

The resin layer can be formed by first dissolving the silicone resins into a solvent to prepare a coating solution, then uniformly coating the surface of the core material with the coating solution by means of the immersion method, the spray method, the brush painting method, etc., and baking it after drying.

There is no particular restriction for the solvent and can be selected suitably from toluene, xylene, methyl ethyl ketone, methyl isobutyl ketone, and celsor butyl acetate, etc.

The coating may be carried out by an external heating system or an internal heating system. For example, a method employing a fixed type electric furnace, a fluid type electric furnace, a rotary type electric furnace, or a burner furnace, and a method employing microwaves, etc., may be mentioned.

It is preferable that the ratio of the resin layer in the carrier (that is, the amount of coating resin) be 0.01 to 5.0% by weight with respect to the total amount of the carrier.

If the ratio (the amount of coating resin) is less than 0.01% by weight, there may be no case where any uniform resin layer is formed on the surface of the core material. If the ratio is less than 0.01% by mass, it is difficult to form a uniform resin layer, while, if the ratio exceeds 5.0% by mass, the resin layer becomes too thick and particle formation between carriers occurs, whereby a uniform carrier fine particles may not be obtained.

In a case where the color developing agent for electrophotography is the two-constituent developing agent, the ratio of content of the two-constituent developing in the carrier has no limitation, which may be suitably selected according to an object. However, for example, it is preferable that the ratio of content thereof be over 50% by weight but less than 99% by weight, more preferably be, over 90% by weight but less than 97% by weight. (That is, it is preferable that the ratio of content of the color toner for electrophotography in the two-constituent developing agent be 1 to 50% by weight, more preferably be 3 to 10% by weight.

The color developing agent according to the present invention may be preferably employed for formation of images by various types of publicly known electrophotographic methods such as the magnetic-constituent developing method, the non-magnetic-constituent developing method, the two-constituent developing method, etc. Moreover, the color developing agent is particularly preferably employed in the following method for forming color images and an apparatus for forming color images according to the present invention.

(Method for Forming Color Images and Apparatus for Forming Color Images)

The method for forming color images according to the present invention includes at least the step of forming an electrostatic latent image by which an electrostatic latent image is formed on an electrostatic latent image carrier; the step of developing the electrostatic latent image by the color developing agent for electrophotography according to the present invention to form a visible image; the step of transferring the visible image onto a recording medium; and the step of flash fixing the image, which is transferred onto the recording medium, wherein such an embodiment is more preferable, in which the method includes at least a developing step of developing the electrostatic latent image by using the color toner for extreme bottom layer, forming an extreme bottom layer image with the color toner for extreme bottom layer, developing the electrostatic latent image with toner for upper layer other than the color toner for extreme bottom layer in the color toners for electrophotography, and forming an upper layer image with the corresponding toner for upper layer; a step of transferring the visible image on the extreme bottom layer and the visible image on the upper layer onto a recording medium so that the corresponding visible image on the extreme bottom layer is placed on the extreme bottom layer and forming a combined transferred image; and a step of flash fixing the combined image transferred onto the recording medium. Also, in the embodiment, although the color toner for extreme bottom layer is used as a requisite, color toners other than the color toner for extreme bottom layer may not contain any infrared ray absorbent.

An embodiment in which at least the color toner for extreme bottom layer is employed is preferable as the color developing agent for electrophotography. More preferably, an embodiment in which the color toner for extreme bottom layer and the toner for upper layer are concurrently employed, and an embodiment particularly preferable is an embodiment in which the color toner for extreme bottom layer and three types of the toner for upper layers are concurrently used. In any of the embodiments, the color toner for extreme bottom layer is used on the extreme layer of the combined transferred image.

The apparatus for forming color images includes at least an electrostatic latent image carrier, means for forming an electrostatic latent image on the corresponding electrostatic latent image carrier, means for developing the electrostatic latent image by using the color toner for electrophotography according to the present invention and forming a visible image, means for transferring the visible image onto a recording medium, and means for flash fixing the image, which is transferred onto the recording medium, wherein such an embodiment is preferable, which comprises at least an electrostatic latent carrier; means for forming an electrostatic latent image on the electrostatic latent image carrier; means for developing an extreme bottom layer in which the electrostatic latent image is developed by using a colorcolor toner for extreme bottom layer in the color toners for electrophotography, which is the color toner for extreme bottom layer comprised of at least two types of color toners selected from black toner, magenta toner, yellow toner and cyan toner, one of the two types of color toners containing an infrared ray absorbent while one type of color toner selected from the magenta toner, the yellow toner, and the cyan toner has a contrast ratio of 35% to 95%, and forming an visible image on the extreme bottom layer, and means for developing the electrostatic latent image by using an toner for upper layer other than the color toner for extreme bottom layer in the color toners for electrophotography and forming an visible image on the upper layer; means for transferring the visible image on the extreme bottom layer and the visible image on the upper layer onto a recording medium so that the corresponding visible image on the extreme bottom layer is placed on the extreme bottom layer and forming a combined transferred image; and means for flash fixing the combined image transferred onto the recording medium.

In the preferred embodiment, although the color toner for extreme bottom layer is used as a requisite, color toners other than the corresponding color toner for extreme bottom layer may not contain the infrared ray absorbent.

A method for forming color images according to the present invention includes, as described above, the steps of forming an electrostatic latent image, developing the electrostatic latent image, transferring the same, and flash fixing the same, and may include the other steps of, for example, eliminating electricity, cleaning, recycling, and controlling, etc., which are suitably selected as necessary. The apparatus for forming color images according to the present invention may include, as described above, an electrostatic latent image carrier, means for forming an electrostatic latent image, means for developing the same, means for transferring the same, and means for flash fixing the same. Further, the apparatus may include the other means, for example, eliminating electricity, cleaning, recycling, and controlling, etc., which are suitably selected as necessary.

The method for forming color images according to the present invention may be preferably carried out by the apparatus for forming color images according to the present invention, wherein the step of forming electrostatic latent images is carried out by the means for forming electrostatic latent images, the developing step is carried out by the developing means, the transferring step is carried out by the transferring means, the flash fixing step is carried out by the flash fixing means, and the other steps are carried out by the other means.

Step of Forming Electrostatic Latent Images and Means for Forming Electrostatic Latent Images The step of forming electrostatic latent images is a step for forming electrostatic latent images on an electrostatic latent image carrier.

With respect to the material, shape, structure, size, etc., of the electrostatic latent image carrier (which may be referred to a "light conductive insulative body" or "photo conductor"), there is no particular restriction. The electrostatic latent image carrier may be suitably selected from those that have been publicly known. However, a drum-like shape is preferable as the shape of the carrier. For example, an inorganic photo conductor such as amorphous silicon, selenium, etc., and an organic photo conductor such as polysilane, phthalopolymetin, etc., may be mentioned as the material thereof.

The electrostatic latent image is formed by, for example, uniformly charging the surface of the electrostatic latent image carrier and exposing the same to light imagewisely according to an image. And the process is carried out by the means for forming an electrostatic latent image.

The means for forming an electrostatic latent image is provided with at least an electric charger that uniformly charges the surface of the electrostatic latent image carrier, and an exposing unit that exposes the surface of the electrostatic latent image carrier imagewisely according to an image.

The charging is carried out by applying voltage to the surface of the electrostatic latent image carrier by using the electric charger.

There is no particular limitation for the electric charger, which can be suitably selected according to an object. However, for example, a publicly known contact charger, which is provided with a conductive or semi-conductive roll, brush, film and rubber blade, and a non-contact electric charger that utilizes corona discharge such as corotron, scorotron, etc., may be mentioned as the electric charger.

The exposure is carried out by, for example, exposing the surface of the electrostatic latent image carrier imagewisely according to an image by using the exposing unit.

There is no particular limitation for the exposing unit as far as exposure can be carried out, imagewisely according to an image, on the surface of the electrostatic latent image carrier, which is electrically charged by the electric charger. And, the exposing unit may be suitably selected according to an object. However, for example, various types of exposing units such as a duplication optical system, a rod lens array system, a laser optical system, a liquid crystal shutter optical system, etc., may be mentioned.

Also, in the present invention, a backside exposure system by which exposure is carried out, imagewisely according to an image, on the backside of the electrostatic latent image carrier may be employed.

Developing Step and Developing Means

The developing step is a step for developing the electrostatic latent image by using the color toners for electrophotography according to the present invention through the color developing agent for electrophotography according to the present invention and forming a visible image.

The visible image can be formed by, for example, developing the electrostatic latent image by using the color toner for electrophotography according to the present invention through the color developing agent for electrophotography according to the present invention, in which the developing means may be employed.

The developing means is provided with at least a developing unit in which the combined set of color toners for electrophotography and color developing agents for electrophotography are accommodated, and which applies the color toner for electrophotography according to the present invention through the color developing agent for electrophotography according to the present invention to the electrostatic latent image in a contacted or non-contacted state.

The developing unit may be of a dry type developing system or a wet type developing system. Also, the same may be of a single-color developing unit or a multi-color developing unit. However, for example, such a type may be preferably mentioned, which is provided with an agitator that agitates, through friction, the color toner for electrophotography according to the present invention through the color developing agent for electrophotography according to the present invention and electrically charges the same, and a rotatable magnet roller.

In the developing unit, for example, the color toner for electrophotography and the carrier are mixed and agitated, and the corresponding color toner for electrophotography is electrically charged by the friction thereof, and are retained on the surface of a rotating magnet roller in a standing state, thereby forming a magnetic brush. Since the corresponding magnet roller is disposed in the vicinity of the electrostatic latent image carrier (photo conductor), a part of the color toner for electrophotography, which constitutes the magnetic brush formed on the surface of the corresponding magnet roller, is transferred onto the surface of the corresponding electrostatic latent image carrier (photo conductor) by electric absorption forces. As a result, the electrostatic latent image is developed by the corresponding color toner for electrophotography, wherein a visible image is formed on the surface of the corresponding electrostatic latent image carrier (photo conductor) by the color toner for electrophotography.

The developing agent that is accommodated in the developing unit includes the color toner for electrophotography according to the present invention and color developing agent for electrophotography according to the present invention. However, the corresponding color developing agent for electrophotography may be a single constituent developing agent or may be a two-constituent developing agent. The toner included in the corresponding color developing agent for electrophotography is the color toner for electrophotography according to the present invention.

Transferring Step and Transferring Means

The transferring step is a step for transferring the visible image onto a recording medium. Such an embodiment is preferred in which a first step of forming a combined transferred image by transferring the visible image on the extreme bottom layer and an upper layer visible layer image onto an intermediate transferring body in order, and a second step of transferring the corresponding combined transferred image onto the recording medium so that the visible image on the extreme bottom layer in the corresponding combined transferred image is placed right onto the recording medium.

The transfer is carried out by electrically charging the electrostatic latent image carrier (photo conductor) by a transfer charger, in which the transferring means is employed therewith. As the transferring means, an embodiment is preferred in which includes a first transferring means for transferring the visible image on the extreme bottom layer and visible image on the upper layer on an intermediate transferring body in order and forming a combined transferred image, and a second transferring means for transferring the corresponding combined transferred image onto the recording medium so that the visible image on the extreme bottom layer in the corresponding combined transferred image is placed right onto the recording medium.

There is no particular limitation for the intermediate transferring body and may be suitably selected from publicly known transferring bodies, according to an object.

With respect to black toner, the black toner may be transferred in any optional order regardless of the color reproduction in the color overlapping when transferring the image. However, in view of color sharpening (addition of black toner), it is preferable that black toner is transferred very last.

The transferring means (the first transferring means and the second transferring means) includes at least a transfer unit by which the visible image formed on the electrostatic latent image carrier (photo conductor) is peeled off and electrically charged. The transferring means may be singular or plural.

As for the transfer unit, a corona transfer unit in which corona discharge is utilized, a transfer belt, transfer roller, pressure transfer roller, adhesion transfer unit, etc., may be used.

There is no particular limitation for the recording medium, and it may be suitably selected from recording media (recording paper) that are publicly known.

Flash Fixing Step and Flash Fixing Means

The flash fixing step is a step for flash fixing a visible image, which is transferred onto a recording medium, using a flash fixing unit, and the step may be carried out whenever an image is transferred onto the recording medium with respect to the respective colors of toners for electrophotography or may be simultaneously carried out in a laminated state of the respective colors with respect to the color toners for electrophotography.

It is preferable that light energy (there may be cases where the light energy is called "flash energy") for the flash fixing be 1 to 3 J/cm$^2$ per color toner, and 3 to 7 J/cm$^2$ for the full three colors.

If the light energy is less than 1 J/cm$^2$ per color toner, satisfying fixing cannot be carried out. But if the light energy exceeds 3 J/cm$^2$, there are cases where color voids may occur or sheets of paper may burn.

The flash fixing can be carried out, for example, by light irradiation by using an optical fixing unit with respect to the visible image transferred onto the recording medium. That is, the flash fixing can be carried out by the flash fixing means.

The flash fixing means has at least a flash fixing unit (flash lamp) that irradiates infrared rays. The flash fixing means may be provided by one or two or more.

There is no particular limitation for the flash fixing unit (flash lamp), and it may be suitably selected according to an object. For example, an infrared ray lamp, Xenon lamp, etc., may be preferably mentioned.

It is preferable that a wavelength for light emission made by the flash fixing means in the flash fixing be close to an absorption wavelength in an infrared ray absorbent to be used.

Light energy (J/cm$^2$) per unit area for a one-time flash light, which indicates the intensity of light emission by the flash (flash lamp) fixing unit can be calculated by the following expression (2):

$$S=((1/2)\times C\times V^2)/(u\times 1)/(n\times f).$$

where [n] indicates the number of lamps, [f] indicates a lighting frequency (Hz), [V] indicates an input voltage (V), [C] indicates the capacity of a capacitor ($\mu$F), [u] indicates a process transfer rate (mm/s), [1] indicates a printing width (mm), and [S] indicates an energy density (J/cm$^2$).

Also, in the present invention, for example, a publicly known fixing unit such as a heat-roller fixing unit, etc., may be used along with or instead of the flash fixing step and the flash fixing means.

The electricity eliminating step is a step for eliminating electricity by applying an electricity eliminating bias to the electrostatic latent image carrier, which can be preferably carried out by the electricity eliminating means.

There is no particular limitation for the electricity eliminating means. Any type that can apply an electricity eliminating voltage to the electrostatic latent image carrier may be acceptable, and may be suitably selected from any electricity eliminating apparatuses that have been publicly known. For example, an electricity eliminating lamp, etc., may be preferably mentioned.

The cleaning step is a step for eliminating the toner for electrophotography remaining on the electrostatic latent image carrier. That is, the step may be preferably carried out by a cleaning means.

There is no particular limitation for the cleaning means. Any type that can remove the toner for electrophotography remaining on the electrostatic latent image carrier may be acceptable, which can be suitably selected from the cleaners that have been publicly known. For example, a magnetic brush cleaner, electrostatic brush cleaner, magnetic roller cleaner, blade cleaner, brush cleaner, web cleaner, etc., may be preferably mentioned.

The recycling step is a step for recycling the color toner for electrophotography, which has been removed in the cleaning step, to the developing means. The step may be preferably carried out by a recycling means.

There is no particular limitation for the recycling means. For example, a transfer means, etc., that has been publicly known may be mentioned.

The controlling step is a step for controlling the respective steps. The step may be preferably carried out by a controlling means.

There is no particular limitation for the controlling means as long as it can control the respective means. The controlling means can be suitably selected according to an object. For example, various apparatuses such as a sequencer controller, a computer, etc., may be used.

With regard to the amount of adhesion in the color toner for electrophotography in a multi-color image, which is formed by the method and apparatus for forming a color image according to the present invention, it is preferable, in view of making the reproduction property of colors through color overlapping compatible with the fixing property thereof in a well-balanced state, that the adhering amount of the color toner for extreme bottom layer to form the visible image on the extreme bottom layer in the corresponding multi-color image is 0.4 to 0.8 mg/cm$^2$, and the adhering amount of the toner for upper layer to form an visible image on the upper layer in the corresponding multi-color image is 0.4 to 0.8 mg/cm$^2$.

If the adhering amount exceeds 0.8 mg/cm$^2$, the fixing property of the color toners for electrophotography is deteriorated, and at the same time, the transmission is also deteriorated even if the contrast ratio of the toners for electrophotography in layers other than the extreme bottom layer in the multi-color image is suppressed, thus the color tone may be worsened. To the contrary, if the adhering amount is less than 0.4 mg/cm$^2$, the fixing property of the toners for electrophotography deteriorates, and simultaneously the color reproduction area may be decreased, accordingly, the chroma is also decreased. With the method and apparatus for forming color images according to the present invention, it is possible to efficiently form high quality images having excellent image resolution (image reproducibility), an excellent color reproducibility in color overlapping, and satisfying color tone.

[Embodiments]

Hereinafter, a description is given of embodiments of the invention, however, the present invention should not be construed to limit its scope by these embodiments.

[Embodiments 1 Through 9, and Comparative Examples 1 Through 9]

Preparation of Color Toners for Electrophotography

Yellow toners (Y0 to Y9), magenta toners (M0 to M3) and cyan toners (C0 to C3) of the compositions shown in Table 1 through 3 are produced as shown below.

The compositions described in Table 1 through Table 3 are input into respective Henshell mixers for preparatory mixing. After that, the compositions are blended by an extruder and are roughly crushed by a hammer mill. Next, the compositions are finely crushed by a jet mill and classified by an air stream classifier, thereby obtaining colored particles whose cubic average particle diameter ($D_{50}$) is 8.5 $\mu$m. Next, hydrophobic silica fine particles (R974, produced by Nippon Aerosil Corp.) of 0.5 parts by weight are externally doped and processed by a Henshell mixer, and respective color toners (Yellow toner (Y0 to Y9), magenta toners (M0 to M3) and cyan toners (C0 to C3) are produced.

The average particle diameter (the average particle diameter of primary particles) of the coloring agent (pigment) used herein is calculated, as shown below, by [Diameter equivalent to the Ferre's Circle].

That is, color toner particles that are frozen by liquid nitrogen are cut off by a microtome to produce ultra thin pieces of toner. The toner ultra-thin cut pieces are photographed by TEM photography (in magnification of 50,000 times). The TEM image thus obtained is read by a dot analyzer DA-5000S (Ohji Keisoku Kiki Co.,). Next, the [Diameter equivalent to the Ferre's Circle] is calculated from the TEM image by the same apparatus. The operation is repeated for 10 particles (equivalent to 200 particles of the coloring agent particles in total) of the color toner. The average value is made into the average particle diameter of the primary size. Also, the [Diameter equivalent to the Ferre's Circle] is a method used to define a solid particle size, and an average of the diameter of a projecting particle has been obtained by measuring the projecting particle at eight angles (0, 22.5, 45, 67.5, 90, −22.5, −45, and −67.5°). The results are shown in Table 1 through Table 3.

Image Formation

A color image was formed by using a GL8300 printer (Fujitsu Corporation).

The GL8300 printer (Fujitsu Corporation) is provided, as shown in FIG. 1, with an intermediate transfer body 10, a black developing unit 20, a cyan developing unit 30, a magenta developing unit 40, a yellow developing unit 50, a first transfer means 60, a second transfer means 70, an flash fixing means 80, and a cleaning means 90.

The intermediate transfer body 10 is a rotating belt, which is rotatably suspended by four rotating rollers, and the black developing unit 20, cyan developing unit 30, magenta developing unit 40, yellow developing unit 50 and second transfer means 70 are disposed at the outer circumferential portion of the intermediate transfer body 10, so that these are faced to the intermediate transfer body 10 in that order. The intermediate transfer body 10 is rotated from the second transfer means 70 side toward the black developing unit 20. In addition, the second transfer means 70 is a transfer charger, which can be driven by the secondary transfer potential feeding means 72.

On the inner circumferential portion of the intermediate transfer body 10, the first four transfer means 60 are disposed so that these are faced to the black developing unit 20, cyan developing unit 30, magenta developing unit 40, and yellow developing unit 50. Also, the first transfer means 60 is a transfer charger and can be driven by the primary transfer potential feeding means 62.

The black developing unit 20, cyan developing unit 30, magenta developing unit 40, and yellow developing unit 50 are, respectively, developing units, each of which is provided with a charging means 1, an exposing means 2, an electrostatic latent image carrier (photo conductor) 3, and a developing means 4. Of these, the electrostatic latent image carrier (photo conductor) 3 is disposed so as to face the outer circumferential portion of the intermediate transfer body 10. And, the charging means 1, exposing means 2 and developing means 4 are disposed on the circumference of the electrostatic latent image carrier (photo conductor) 3 so that these are faced to the electrostatic latent image carrier (photo conductor) 3.

With respect to the GL8300 printer (Fujitsu Corporation), in the black developing unit 20, the charging means 1 uniformly charges the surface of the electrostatic latent image carrier (photo conductor) 3. Next, the exposing means 2 causes the surface of the electrostatic latent image carrier (photo conductor) 3 to be exposed to light imagewisely according to an image, which is the same as the black image to be formed, wherein a black electrostatic latent image is formed on the electrostatic latent image carrier (photo conductor) 3, and the developing means 4 develops the image by applying black toner, which is accommodated therein, to the corresponding black electrostatic latent image, thereby forming a black visible image.

Next, in the cyan developing unit 30, the charging means 1 uniformly charges the surface of the electrostatic latent image carrier (photo conductor) 3. Next, the exposing means 2 causes the surface of the electrostatic latent image carrier (photo conductor) 3 to be exposed to light imagewisely according to an image, which is the same as the cyan image to be formed, wherein a cyan electrostatic latent image is formed on the electrostatic latent image carrier (photo conductor) 3, and the developing means 4 develops the image by applying cyan toner, which is accommodated therein, to the corresponding cyan electrostatic latent image, thereby forming a cyan visible image.

Next, in the magenta developing unit 40, the charging means 1 uniformly charges the surface of the electrostatic latent image carrier (photo conductor) 3. Next, the exposing means 2 causes the surface of the electrostatic latent image carrier (photo conductor) 3 to be exposed to light imagewisely according to an image, which is the same as the magenta image to be formed, wherein a magenta electrostatic latent image is formed on the electrostatic latent image carrier (photo conductor) 3, and the developing means 4 develops the image by applying magenta toner, which is accommodated therein, to the corresponding magenta electrostatic latent image, thereby forming a magenta visible image.

Next, in the yellow developing unit 50, the charging means 1 uniformly charges the surface of the electrostatic latent image carrier (photo conductor) 3. Next, the exposing means 2 causes the surface of the electrostatic latent image carrier (photo conductor) 3 to be exposed to light imagewisely according to an image, which is the same as the yellow image to be formed, wherein a yellow electrostatic latent image is formed on the electrostatic latent image carrier (photo conductor) 3, and the developing means 4 develops the image by applying yellow toner, which is accommodated therein, to the corresponding yellow electrostatic latent image, thereby forming a yellow visible image.

A black visible image, cyan visible image, magenta visible image and yellow visible image, which are formed on the respective electrostatic latent image carriers (photo conductor) 3 in the black developing unit 20, cyan developing unit 30, magenta developing unit 40 and yellow developing unit 50 are sequentially transferred onto and laminated on the intermediate transfer body 10 in that order by an action of transfer potential made by the first transfer means 60, wherein a full-color combined transferred image consisting of black, cyan, magenta and yellow is thus formed. Also, at this time, in the corresponding combined transferred image, toners are laminated in the order of black, cyan, magenta, and yellow from the intermediate transfer body 10 side.

Next, the combined transferred image is once transferred onto a recording medium by an action of the transfer potential, which is brought about by the second transfer means 70, in that order, wherein a full-color combined transferred image of black, cyan, magenta and yellow is formed on the recording medium. Also, at this time, in the corresponding combined transferred image, yellow, magenta, cyan and black toners are laminated from the recording medium side in that order. Herein, the recording medium is normal paper (Kobayashi Kirokushi CO., NIP-1500LT).

And, the combined transferred image formed on the recording medium is transferred to the flash fixing means 80, wherein the image toner is exposed to light irradiation from the flash fixing means 80 and is melted to be light fixed on the recording medium. Thus, the combined transferred image is firmly fixed on the recording medium, thereby a full-color image is formed by the corresponding combined transferred image.

Also, toners remaining on the intermediate transfer body 10 are removed by a cleaning blade that acts as the cleaning means 90.

Figure 2:
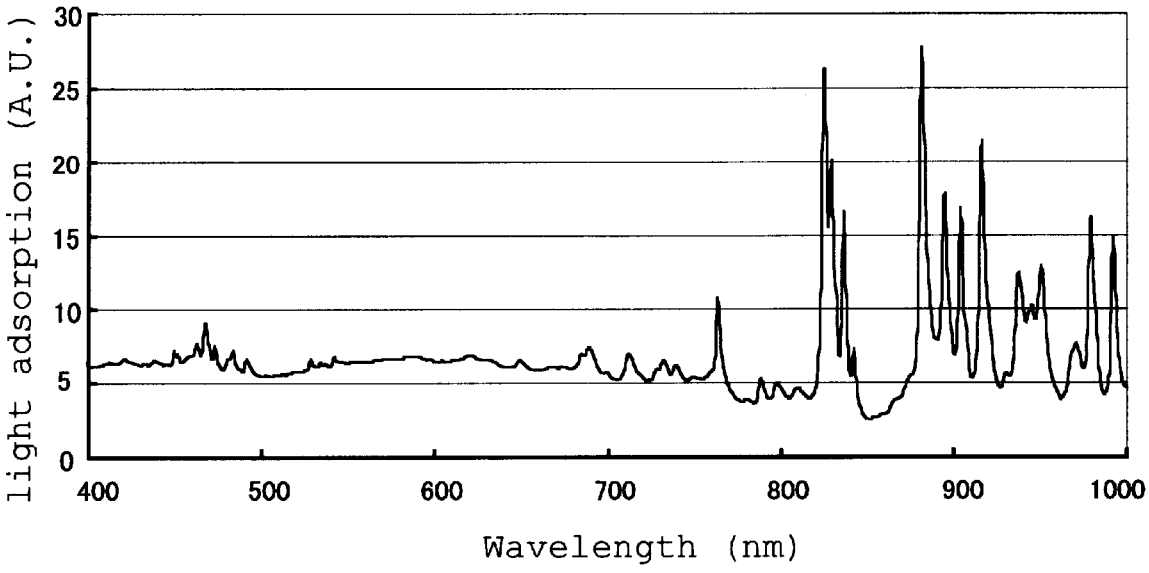
FIG. 2 is a graph showing a light-emitting waveform of a flash fixing unit.

Further, herein, yellow toners (Y0 to Y9) were used as the yellow toner, magenta toners (M0 to M3) were used as the magenta toner, and cyan toners (C0 to C3) were used as the cyan toner. A flash (flash lamp) fixing unit in a flash printer PS 2160 (Fujitsu Corporation) was employed as the flash fixing means 80. In addition, the waveform of light emission of the corresponding flash (flash lamp) fixing unit is shown in FIG. 2, wherein the light energy of the corresponding flash (flash lamp) fixing unit was 5 J/cm$^2$.

Evaluation of Color Tone

Figure 3:
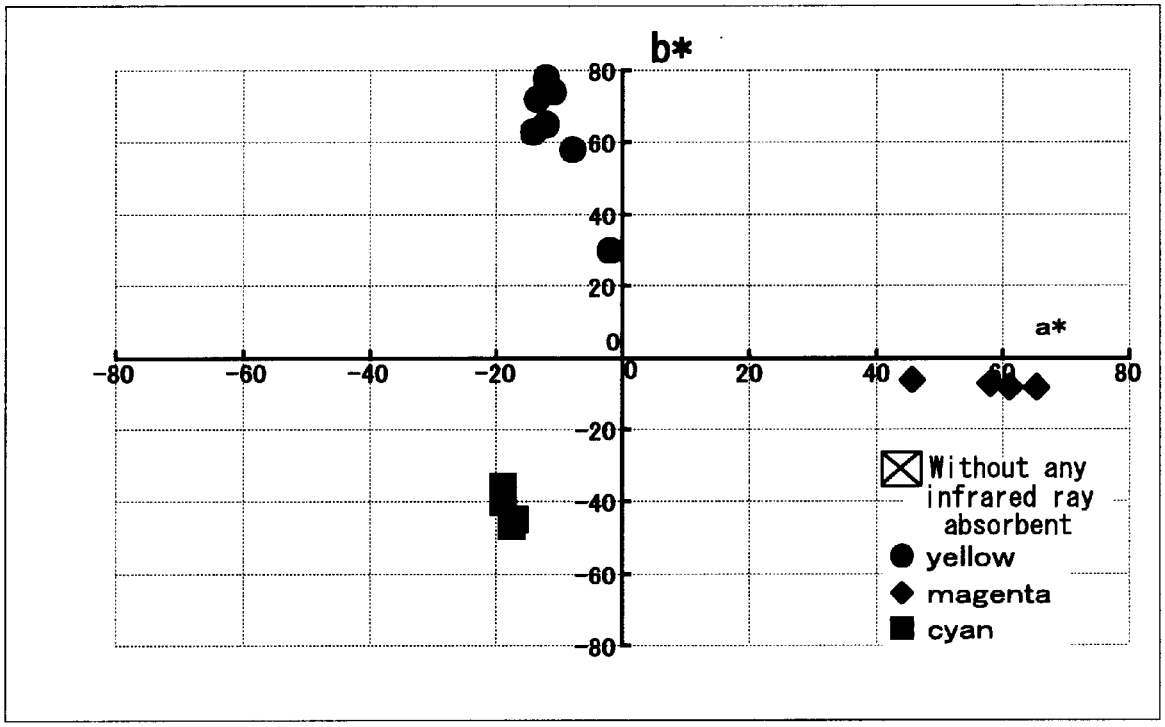
FIG. 3 is a view showing the measurement result of [a*] and [b*] in a visible image that is formed with yellow toner, magenta toner and cyan toner.

With respect to the combined transferred image that is formed by laminating the respective color toners of black, cyan, magenta and yellow, the [a*] and [b*] values thereof are measured and evaluated in compliance with the object color indication method regulated by JIS Z8729. The results thereof are shown in FIG. 3.

Measurement and Calculation of Color Tone Difference

Yellow toner, magenta toner and cyan toner are produced in the same manners as in the production of yellow toners (Y0 to Y9), magenta toners (M0 to M3) and cyan toners (C0 to C3) in the [Preparation of color toners for electrophotography], except that no infrared ray absorbent is used. The color tone thereof is evaluated in the same manner as that for evaluating the color tones, wherein a color tone difference Δ(E) was measured and calculated. The results thereof are shown in Tables 1 through 3 and in FIG. 4.

Also, where the color tone difference Δ(E) is 10 or less, the level is excellent to such a degree that it cannot be visibly discriminated, in comparison with the case where no infrared ray absorbent is included.

Measurement and Evaluation of the Contrast Ratio (Relationship Between the Contrast Ratio and the Color Tone Difference)

Figure 4:
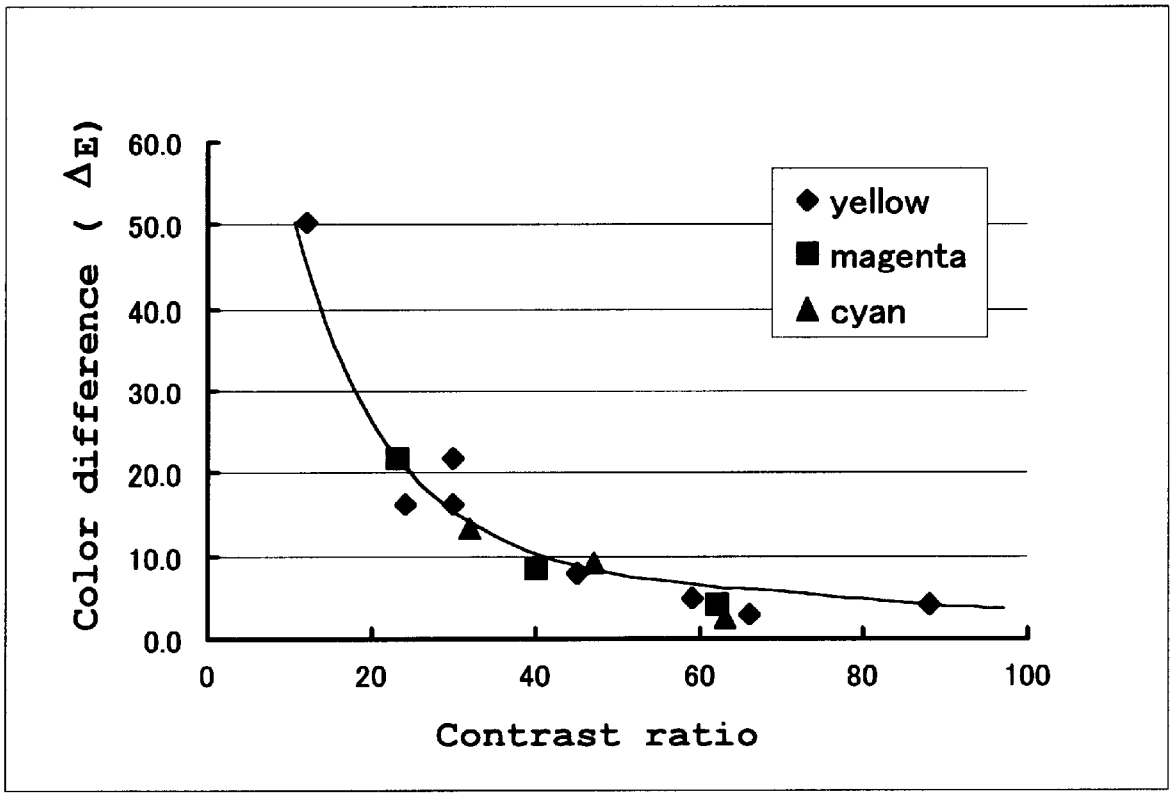
FIG. 4 is a graph showing the relationship between the contrast ratio and color tone difference (ΔE) in a visible image that is formed with yellow toner, magenta color, and cyan color.

With respect to the combined transferred image that is formed by laminating the respective color toners of cyan, magenta and yellow, the contrast ratio thereof was measured as described below. The results are shown in Tables 1 through 3. Also, the results of measurement of the "color tone difference" and "contrast ratio" are shown in FIG. 4. As shown in FIG. 4, the larger the contrast ratio becomes, the smaller the color tone difference becomes. It can be presumed that color influences in the infrared ray absorbent are scarcely brought about due to the effect of masking of the toners. In addition, it becomes preferable that the contrast ratio is made into 40% or more as the color tone difference becomes 10 or less, and it is more preferable that the contrast ratio is made into 55% or more. Thus, if the contrast ratio is set to 35% or more, influences due to colors in the infrared ray absorbent may be suppressed.

Measurement and Calculation of the Contrast Ratio

Tetrahydrofuran of 40 grams, and each color toner of cyan, magenta, or yellow, each consisting of 10 grams, are blended and dissolved and dispersed by a paint shaker for one hour. The toner solution thus produced is coated onto white paper (reflectivity: 80±1) and black paper (reflectivity: 2 or less), which are regulated in [JIS K5101] by using a No.16 bar coater and then dried, thereby producing samples.

With respect to the respective samples, the brightness of the respective samples is measured by a spectrometer (938 Spectrodentitometer, X-Rite Corp.), and the contrast ratios are calculated by using the following expression (1):

$$\text{Contrast ratio } (\%) = (LB/LW) \times 100.$$

(where [LB] indicates the brightness on the black paper, [LW] indicates the brightness on the white paper). Also, although [JIS K5101] regulates a visible evaluation, numeric evaluation is carried out herein.

Figure 5:
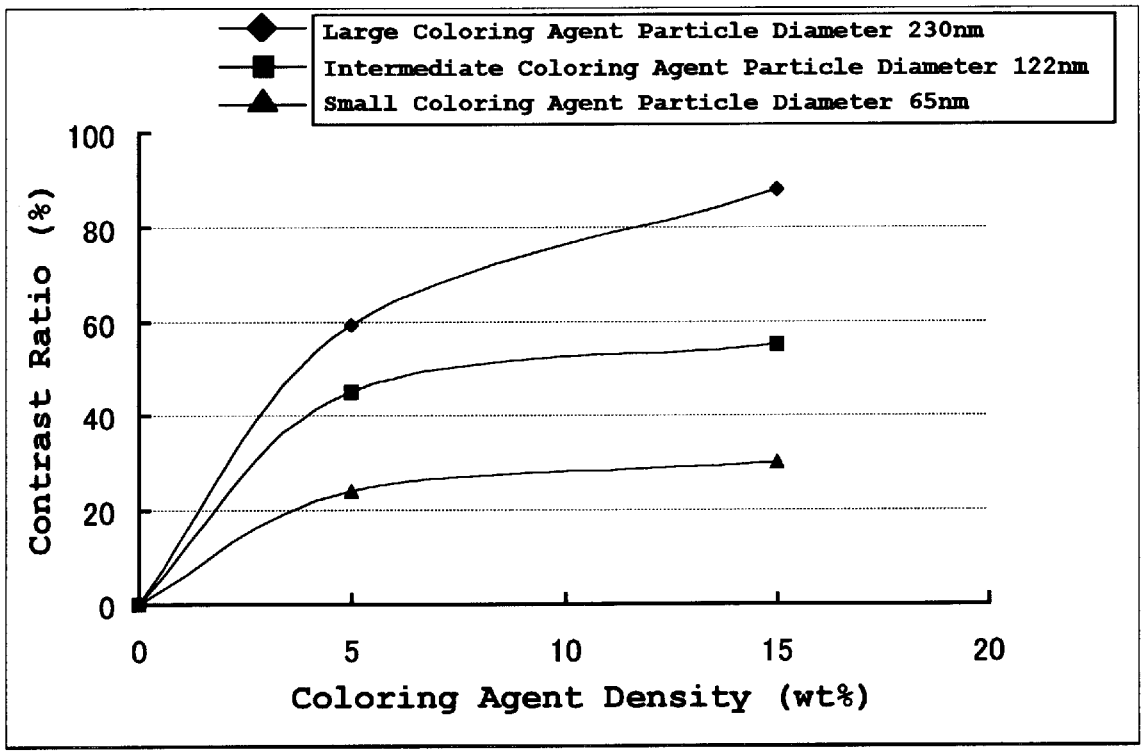
FIG. 5 is a graph showing the relationship between the average particle diameter of primary particles, concentration and contrast ratio of a coloring agent.

Evaluation of the Average Particle Diameter of Primary Particles/Containing Density of Primary Particles, and Contrast Ratio FIG. 5 shows the relationship between the average particle diameter of primary particles of the coloring agents used for the respective yellow toners Y0 to Y9, containing density thereof (pigment density in FIG. 5), and the contrast ratio (masking degree in FIG. 5). The contrast ratio closely pertains to the permeability of visible light, wherein it is considered that, if the average particle diameter of the primary particles is small, the visible light transmits and appears transparent, and to the contrary, if the average particle diameter of the primary particle is large, the visible light does not transmit, and the contrast ratio is increased. In fact, as shown in FIG. 5, where a coloring agent whose average particle of primary particles is 122 nm and 230 nm, which are larger than the average particle diameter of 100 nm, is used, the contrast ratio was adjusted in a numeric range of 35% to 95%. Also, as shown in FIG. 5, the contrast ratio pertains to the content ratio of the coloring agent, wherein if the content ratio of the coloring agent in the yellow toner is set to 3 to 15% by weight, the contrast ratio was adjusted in the numeric range.

Fixing Rate Test (Tape Peeling Test)

With respect to the combined transferred image which is formed by laminating the respective toners of black, cyan, magenta and yellow, the density of status A on the normal paper on which a toner image is fixed was measured. Next, a peel-off tape is peeled off after the peel-off tape (Brand name: Scotch Meding Tape, produced by SUMITOMO 3M Corp.) is adhered onto the toner image on the normal paper, and the density of status A on the normal paper was measured after the tape was peeled off. Further, the image printing density on the normal paper after the peeling is expressed in terms of percentage where it is assumed that the image printing density on the normal paper before peeling off the tape is 100. This is regarded as the fixing rate of toner. The image printing density was evaluated on the basis of the following evaluation criteria. The results thereof are shown in Table 1 through Table 3.

Also, a spectrometer (938 Spectrodentitometer, X-RITE Corp.) was used for measurement of the status density.

Evaluation Criteria of the Fixing Property

◎ when the fixing ratio is 90% or more.

○ when the fixing ratio is 80% or more but less than 90%.

Δ when the the fixing ratio is 70% or more but less than 80%.

X when the the fixing ratio is less than 70%.

If the fixing ratio is 80% or more, although do not cause any problem in practical applications.

Evaluation of Burning of Paper

When flashing is carried out on the same spot on paper three times, when forming an image, due to erroneous flashing operations when a paper jam occurs, paper burning is visibly checked. There is no spot where burning of paper occurred.

TABLE 1

| | Name | Embod. 1 Y2 | Embod. 2 Y3 | Embod. 3 Y5 | Embod. 4 Y8 | Embod. 5 Y9 | Comp. Ex. 1 Y0 | Comp. Ex. 2 Y1 | Comp. Ex. 3 Y4 | Comp. Ex. 4 Y6 | Comp. Ex. 5 Y7 |
|---|---|---|---|---|---|---|---|---|---|---|---|
| Yellow pigment | Brilliant yellow 5G × 03 (Clariant) C.I.pigment: yellow 74, Primary particle diameter: 65 nm | — | — | — | — | — | 5.0 | 5.0 | 15.0 | — | 2.5 |
| | Brilliant yellow 5G × W (Clariant) C.I.pigment: yellow7, Primary particle diameter: 122 nm | 5.0 | — | — | — | — | — | — | — | — | — |
| | Brilliant yellow 2G × 70 (Clariant) C.I.pigment: yellow 74, Primary particle diameter: 230 nm | — | 5.0 | 15.0 | 5.0 | 2.0 | — | — | — | 2.5 | — |
| White pigment | Ytterbium oxide (UU-HP, Shinetsu Kagaku) | — | — | — | 6.0 | — | — | — | — | — | — |
| Binder | Polyester (FN 119, Kao) | 93.0 | 93.0 | 83.0 | 93.0 | 96.0 | 93.5 | 93.0 | 83.0 | 95.5 | 95.5 |
| Charge control agent | E-89 (Kalix Allen, Orient) | 1.0 | 1.0 | 1.0 | 1.0 | 1.0 | 1.0 | 1.0 | 1.0 | 1.0 | 1.0 |
| Infrared ray absorbent | YKR-5010 | 0.5 | 0.5 | 0.5 | 0.5 | 0.5 | 0.0 | 0.5 | 0.5 | 0.5 | 0.5 |
| Wax | NP105 (Mitsui Kagaku) | 0.5 | 0.5 | 0.5 | 0.5 | 0.5 | 0.5 | 0.5 | 0.5 | 0.5 | 0.5 |
| Result of evaluation | L* | 85.0 | 86.0 | 91.0 | 90 | 80 | 90 | 84.0 | 80.0 | 82 | 70 |
| | a* | −13.5 | −12 | −11.0 | −12 | −10 | −12 | −14.2 | −12.0 | −8 | −2 |

TABLE 1-continued

| | Name | Embod. 1 Y2 | Embod. 2 Y3 | Embod. 3 Y5 | Embod. 4 Y8 | Embod. 5 Y9 | Comp. Ex. 1 Y0 | Comp. Ex. 2 Y1 | Comp. Ex. 3 Y4 | Comp. Ex. 4 Y6 | Comp. Ex. 5 Y7 |
|---|---|---|---|---|---|---|---|---|---|---|---|
| (Primary color) | b* | 72.0 | 75 | 74.0 | 75 | 70 | 78 | 63.0 | 65.0 | 58 | 30 |
| | ΔE | 8.0 | 5.0 | 4.2 | 21.9 | 8.2 | 0 | 16.3 | 16.4 | 21.9 | 50.2 |
| | Contrast ratio | 45 | 59 | 88 | 66 | 35 | 22 | 24 | 30 | 30 | 12 |
| Fixing property | | 91% ○ | 92% ○ | 85% ○ | 90% ○ | 93% ○ | 20% or less x | 90% ○ | 73% Δ | 90% ○ | 91% ○ |

TABLE 2

| Embodiment and control | Name | Embod. 6 M2 | Embod. 7 M3 | Comp. Ex. 6 M0 | Comp. Ex. 7 M1 |
|---|---|---|---|---|---|
| Magenta pigment | Red Violet ER 02 C.I.Pigment:Violet19, Primary particle diameter: 60 nm | — | — | 5.0 | 5.0 |
| | FAST RED E5B C.I.Pigment:violet19, Primary particle diameter: 110 nm | 5.0 | — | — | — |
| | RED E2B70 C.I.Pigment:violet19, Primary particle diameter: 230 nm | — | 5.0 | — | — |
| Binder | Polyester (FN119, Kao) | 93.0 | 93.0 | 93.5 | 93.0 |
| Charge control agent | E-89 (Kalix Allen, Orient) | 1.0 | 1.0 | 1.0 | 1.0 |
| Infrared ray absorbent | YKR-5010 | 0.5 | 0.5 | 0.0 | 0.5 |
| Wax | NP105 (Mitsui Chemical) | 0.5 | 0.5 | 0.5 | 0.5 |
| Results of evaluation (Primary color) | L* | 50.0 | 54 | 54.0 | 45.0 |
| | a* | 58.0 | 61 | 65.3 | 45.6 |
| | b* | −7.3 | −8.3 | −8.0 | −6.0 |
| | ΔE | 76.9 | 81.9 | 85.1 | 64.3 |
| | Contrast ratio | 40 | 62 | 24 | 23 |
| | Fixing property | 90% or more ○ | 90% or more ○ | 20% or less x | 90% or more ○ |

TABLE 3

| Embodiment and control | Name | Embod. 8 C2 | Embod. 9 C3 | Comp. Ex. 8 C0 | Comp. Ex. 9 C1 |
|---|---|---|---|---|---|
| Cyan pigment | Blue B2G C.I.Pigment:Blue15:3, Primary particle diamter 60 nm | — | — | 5.0 | 5.0 |
| | Blue AFL C.I.Pigment:Blue15:2, Primary particle diamter 120 nm | 5.0 | — | — | — |
| | Hostaperm BlueB2G-D C.I.Pigment:Blue15:3, Primary particle diamter 210 nm | — | 5.0 | — | — |
| Binder | Polyester (FN119, Kao) | 93.0 | 93.0 | 93.5 | 93.0 |
| Charge control agent | E-89 (Kalix Allen, Orient) | 1.0 | 1.0 | 1.0 | 1.0 |
| Infrared ray absorbent | YKR-5010 | 0.5 | 0.5 | 0.0 | 0.5 |
| Wax | NP105(Mitsui Kagaku) | 0.5 | 0.5 | 0.5 | 0.5 |
| Results of evaluation (Primary colors) | L* | 52.0 | 56 | 58 | 50.0 |
| | a* | −19.0 | −17 | −17.4 | −19.0 |
| | b* | −40.0 | −45 | −46.6 | −36.0 |
| | ΔE | 9.1 | 2.6 | 0 | 13.4 |
| | Contrast ratio | 47 | 63 | 30 | 32 |
| Fixing property | | 90% or more ○ | 90% or more ○ | 20% or less x | 90% or more ○ |

Also, in Tables 1 through 3, naphthalocyanine compound (Yamamoto Kasei Co., Ltd., Maximum absorption wavelength=880 nm, and Color tone: Green) was used as the infrared ray absorbent KR-5010).

(Embodiments 10 Through 27)

Using yellow toner, magenta toner, and cyan toner that have been prepared in Embodiments 1 through 9 and Comparative examples 1 through 9, the first layer and the second layer are sequentially laminated on the recording medium with respective color toners shown in Tables 4 through 6 as in "Formation of Image" which was carried out in Embodiments 1 through 9 and Comparative examples 1 through 9, and a combined transferred image is formed. After two color toners are simultaneously fixed and an image is formed of the corresponding combined transferred image, the color tone is measured and evaluated in the same manner as that in Embodiments 1 through 9 and Comparative examples 1 through 9. The results thereof are shown in Tables 4 through 6.

Further, in order to form the first layer, respective color toners of Y3, M3 and C3, which has brought about satisfying results in Embodiments 1 through 9 and Comparative examples 1 through 9, were used.

As shown in Tables 4 through 6, if the contrast ratio of the toner of the second layer is 50% or less, blue, red and green on the second layer can be visibly distinguished. However, if the contrast ratio of the second layer exceeds 50%, only the color of the upper layer (the second layer) can be distinguished. Therefore, it is preferable that the contrast ratio of the toner of the second layer be 50% or less. Also, where respective color toners of Y1, M1 and C1 whose contrast ratio is low are used for the second layer, such a result was brought about, in which the chroma is slightly narrowed, as in Embodiments 1 through 9 and Comparative examples 1 through 9, in the results of measurement of [L*], [a*], and [b*] values due to influences of color of the infrared ray absorbent.

TABLE 4

| Embodiment No. | | Embod. 10 | Embod. 11 | Embod. 12 | Embod. 13 | Embod. 14 | Embod. 15 |
|---|---|---|---|---|---|---|---|
| Color overlapping | First layer | Y3 | Y3 | Y3 | Y3 | Y3 | Y3 |
| | Second layer | M1 | M2 | M3 | C1 | C2 | C3 |
| | Third layer | — | — | — | — | — | — |
| | Forth layer | — | — | — | — | — | — |
| Color tone | L* | 36.0 | 35.2 | 44.9 | 33.0 | 34.2 | 45.5 |
| | a* | 57.1 | 62.0 | 59.0 | −62.0 | −67.0 | −17.0 |
| | b* | 35.3 | 45.2 | −8.2 | 20.0 | 27.0 | −40.0 |
| | Visual | Red | Red | Magenta | Green | Green | Cyan |
| | Judgement | ○ | ◎ | x | ○ | ◎ | x |

TABLE 5

| Embodiment No. | | Embod. 16 | Embod. 17 | Embod. 18 | Embod. 19 | Embod. 20 | Embod. 21 |
|---|---|---|---|---|---|---|---|
| Color overlapping | First layer | M3 | M3 | M3 | M3 | M3 | M3 |
| | Second layer | Y1 | Y2 | Y3 | C1 | C2 | C3 |
| | Third layer | — | — | — | — | — | — |
| | Forth layer | — | — | — | — | — | — |
| Color tone | Visual | Red | Red | Yellow | Blue | Blue | Cyan |
| | Judgement | ○ | ◎ | x | ○ | ◎ | x |

TABLE 6

| Embodiment No. | | Embod. 22 | Embod. 23 | Embod. 24 | Embod. 25 | Embod. 26 | Embod. 27 |
|---|---|---|---|---|---|---|---|
| Color overlapping | First layer | C3 | C3 | C3 | C3 | C3 | C3 |
| | Second layer | Y1 | Y2 | Y3 | M1 | M2 | M3 |
| | Third layer | — | — | — | — | — | — |
| | Forth layer | — | — | — | — | — | — |
| Color tone | Visual | Green | Green | Yellow | Blue | Blue | Magenta |
| | Judgement | ○ | ◎ | x | ○ | ◎ | x |

(Embodiments 28 Through 33)

Using yellow toner, magenta toner, and cyan toner that are prepared in Embodiments 1 through 9 and Comparative examples 1 through 9, the first, second and third layers are sequentially laminated on the recording medium by a combination of the respective toners shown in Table 7 in the same manner as that in "Formation of Image", which was carried out in Embodiments 1 through 9 and Comparative examples 1 through 9, and the three color toners are simultaneously fixed to form an image. After that, the reproduction property of black was checked. The results are shown in Table 7.

Figure 7:
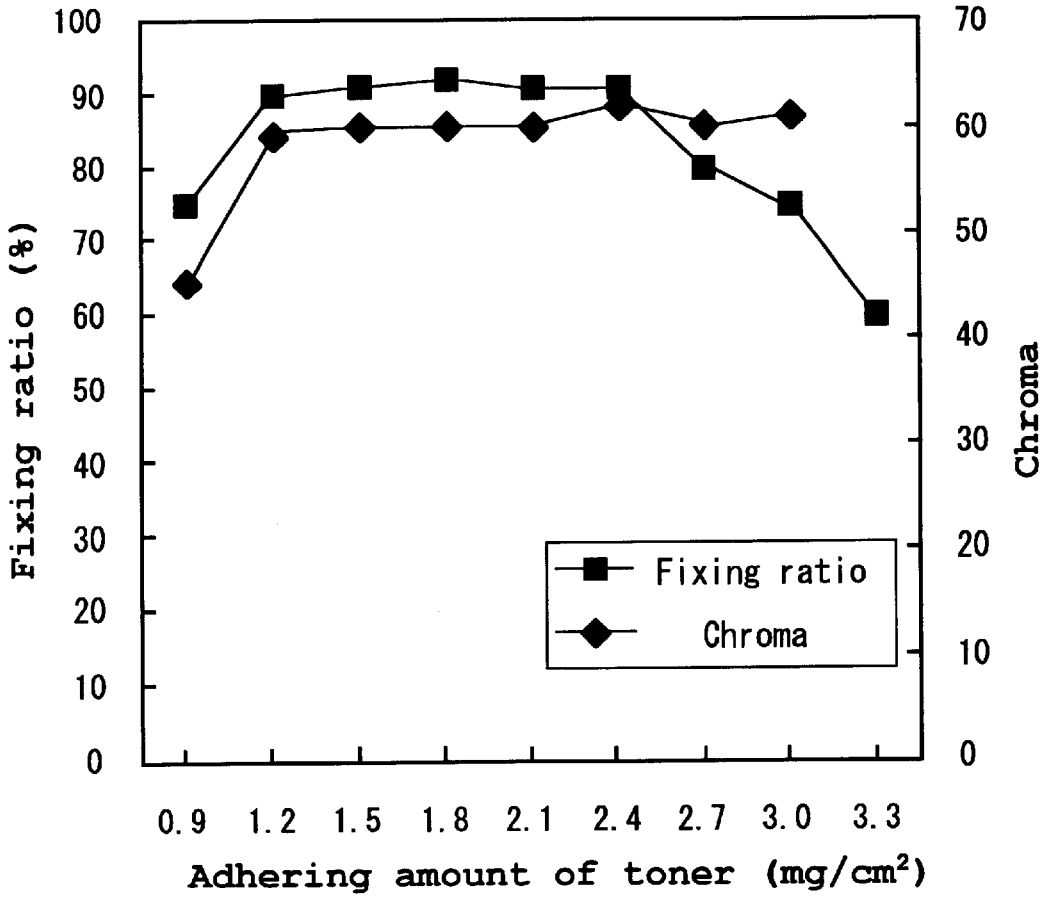
FIG. 7 is a graph showing the relationship between an adhering amount, fixing ratio and chroma of color toner.

As shown in FIG. 7, colors are caused to overlap each other in a state where the color toner of the first layer is made into the color toner for extreme bottom layer (masking toner), and the color toners of the second and third layers are made into the toner for upper layers (non-masking toners), wherein a favorable black color could be obtained. In addition, if the contrast ratio of color toners of the second and third layers is made into 30 to 50%, a further favorable black color could be obtained.

TABLE 7

| Embodiment No. | | Embod. 28 | Embod. 29 | Embod. 30 | Embod. 31 | Embod. 32 | Embod. 33 |
|---|---|---|---|---|---|---|---|
| Color overlapping | First layer | Y8 | Y8 | Y8 | Y8 | Y8 | Y8 |
| | Second layer | M1 | M1 | M1 | M2 | M2 | M2 |
| | Third layer | C1 | C2 | C3 | C1 | C2 | C3 |
| | Forth layer | — | — | — | — | — | — |
| Color tone | Visual | Black (Light brown) | Black (gray) | Blue | Black (gray) | Black | Blue |
| | Judgement | Δ | ○ | x | ○ | ◎ | x |

(Embodiment 34)

Figure 6:
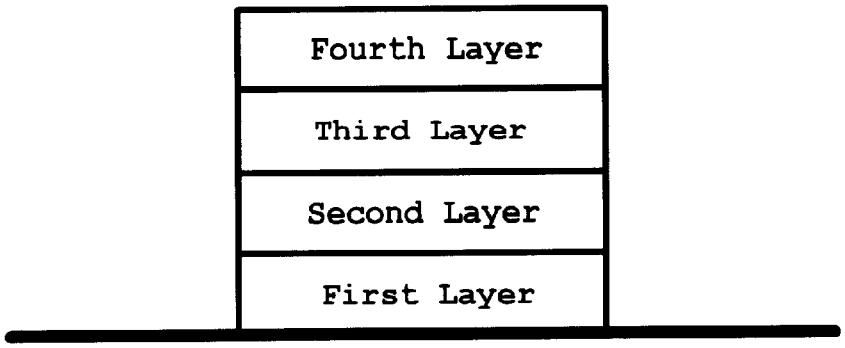
FIG. 6 is a conceptual view showing a state in which color toner and black toner are laminated by four layers on a recording medium.

As shown in FIG. 6, using Y8 yellow toner for the first layer, M2 magenta toner for the second layer, C2 cyan toner for the third layer, and general flash monochrome toner for the fourth layer, a full-color image of a natural image was output in the same manner as that in [Formation of Image], which was carried out in Embodiments 1 through 9 and Comparative examples 1 through 9. At this time, a bright full-color image could be obtained as in the case of fixing by a normal heat-roll. And, the color tone and fixing property were favorable.

(Embodiment 35)

Using Y8 yellow toner for the first layer, M2 magenta toner for the second layer, and C2 cyan toner for the third layer, an image was formed by uniformly adhering the respective toners onto normal paper as in [Formation of Image], which was carried out in Embodiments 1 through 9 and Comparative examples 1 through 9, wherein the relationship between the adhering amount of toners, fixing ratio of the image and brightness was evaluated. The results are shown in FIG. 7.

As shown in FIG. 7, if the total adhering amount of three color toners is 1.2 to 2.4 mg/cm$^2$ (0.4 to 0.8 mg/cm$^2$ per color), favorable fixing could be obtained. Also, if the total adhering amount of three color toners is 1.2 mg/cm$^2$ (0.4 mg/cm$^2$ per color) or more, the brightness was favorable.

Figure 8:
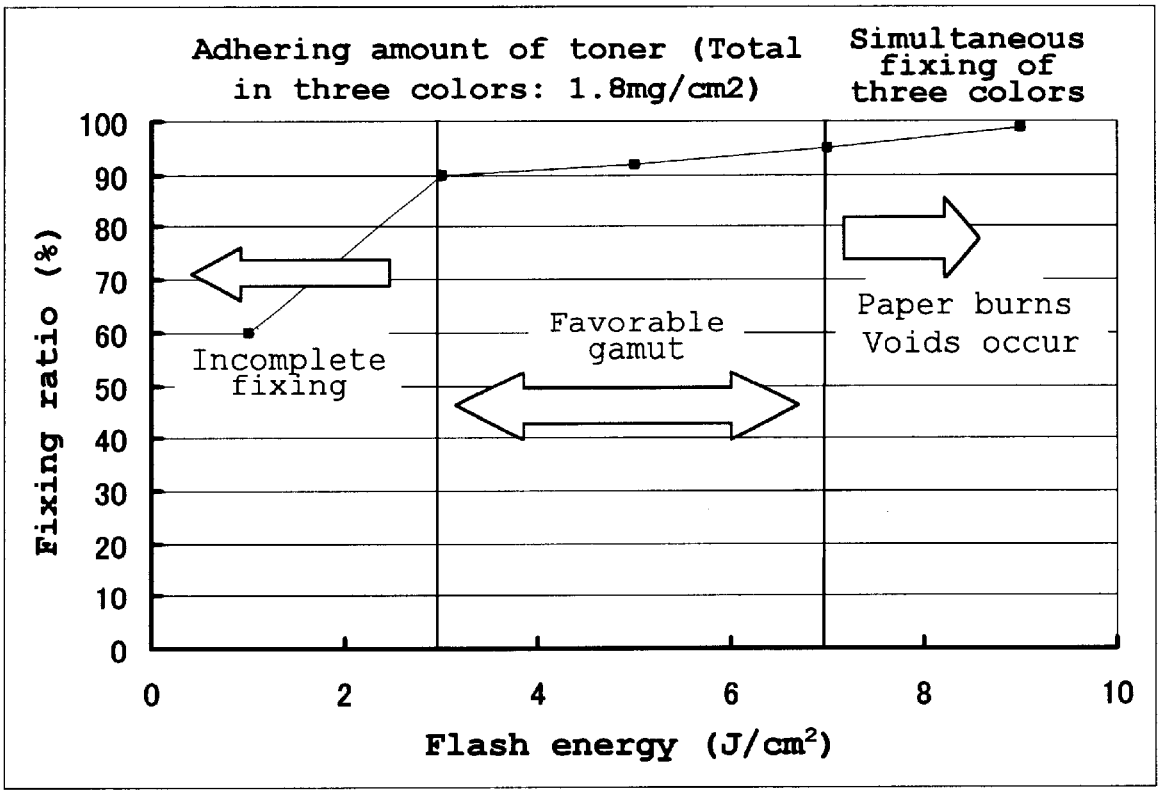
FIG. 8 is a graph showing the relationship between flash energy and a fixing ratio.

Also, using Y8 yellow toner for the first layer, M2 magenta color for the second layer, and C2 cyan toner for the third layer, an image was formed by uniformly adhering the respective toners onto normal paper as in [Formation of Image], which was carried out in Embodiments 1 through 9 and Comparative examples 1 through 9, wherein the relationship between flash energy when fixed the image and the fixing ratio of the image was evaluated. The results are shown in FIG. 8. As shown in FIG. 8, if the flash energy is set to 3 to 7 J/cm$^2$ when fixing the image, a favorable fixing property could be obtained.

If the flash energy exceeds 7 J/cm$^2$, paper burns, and voids (white spaces) may occurs in the line drawing of the toner, and if the flash energy is less than 3 J/cm$^2$, the fixing property of image becomes 90% or less, wherein if the image is rubbed, it may be peeled off.

(Embodiment 36)

As shown in FIG. 6, using Y8 yellow toner for the first layer, M2 magenta toner for the second layer, C2 cyan toner for the third layer, and general black toner for the fourth layer, an image was formed as in [Formation of Image], which was carried out in Embodiments 1 through 9 and Comparative examples 1 through 9, excepting that four flash printers PS2160 (Fujitsu Corp.) are controlled in series and [Formation of Image] carried out in Embodiments 1 through 9 and Comparative examples 1 through 9, and Y8, M2, C2 and a general black toner are developed and fixed in order, wherein the color tone was evaluated. According to the results, even if the respective color toners are fixed one by one, a favorable full-color image could be obtained.

Figure 9:
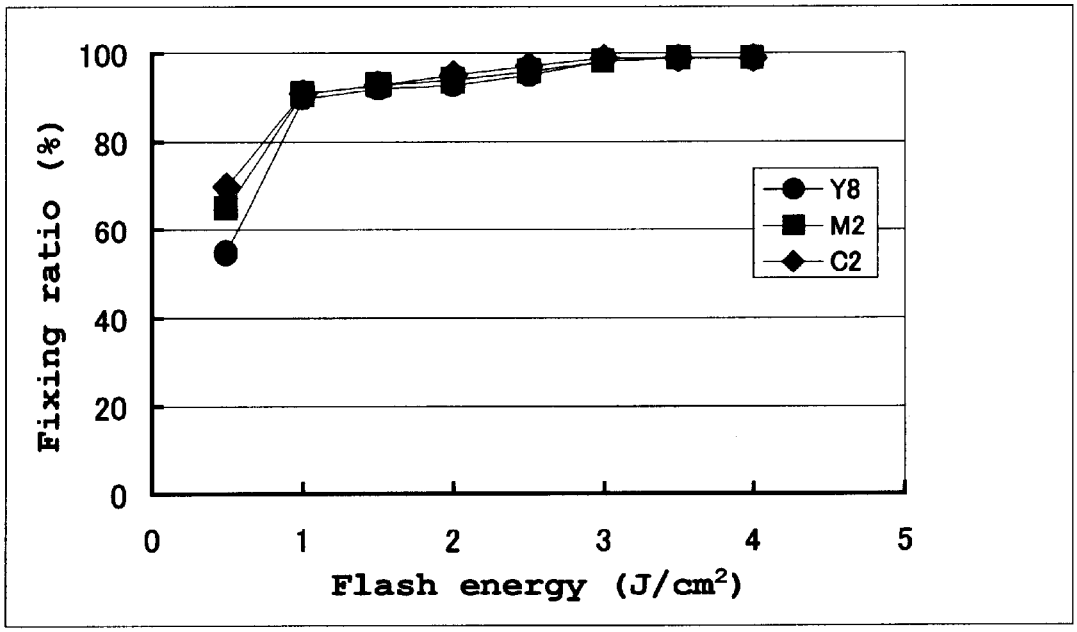
FIG. 9 is a graph showing the relationship between flash energy and a fixing ratio.
Figure 10:
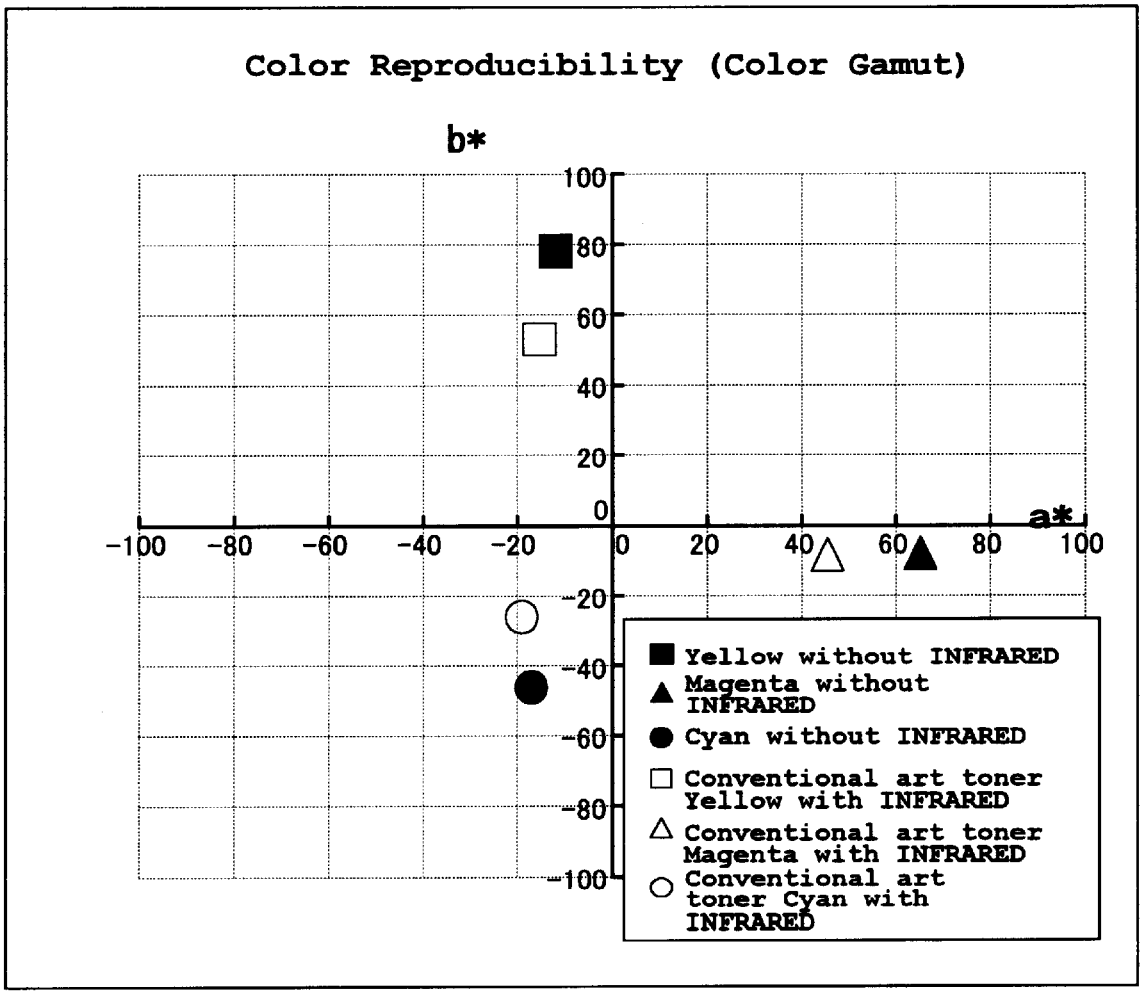
FIG. 10 is a view showing a color reproducibility of conventional art color toner.
Figure 11:
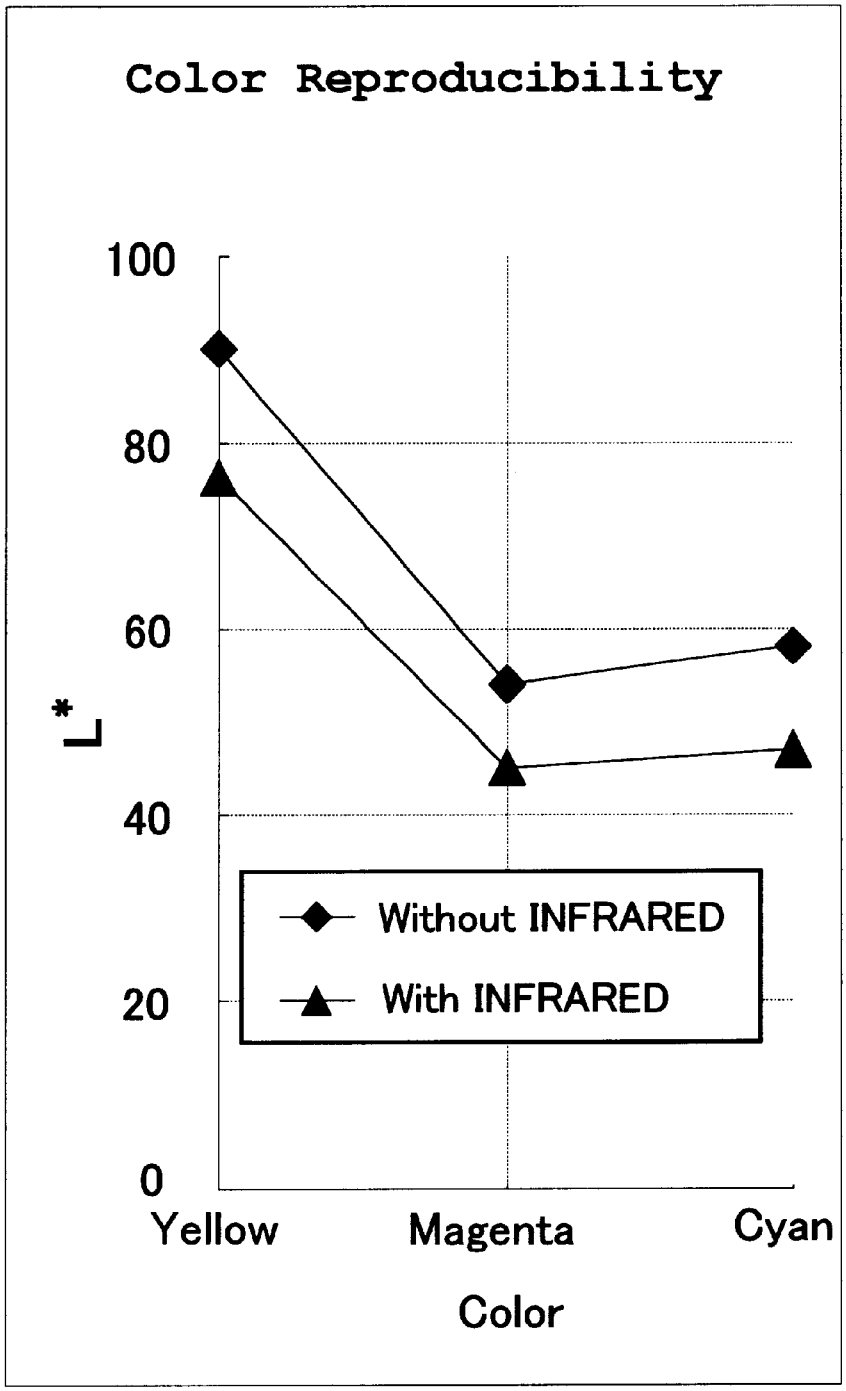
FIG. 11 is a view showing a color reproducibility of conventional art color toner.

Further, the relationship between the flash energy and the fixing ratio of the image was evaluated. The results thereof are shown in FIG. 9. In the formation of an image, if the flash energy of the respective flash fixing units is set in a range from 1 to 3 J/cm$^2$, a high fixing property could be obtained. If the flash energy is less than 1 J/cm$^2$, the fixing became incomplete, and if the flash energy exceeds 3 J/cm$^2$, voids occurred.

The present invention provides a color toner for electrophotography, being preferable as a flash fixing toner that can be processed at a high speed, and excellent in the fixing property, image resolution (image reproducibility) when fixed, and color reproducibility in color overlapping, and having a preferable color tone, by which a multi-color image can be formed; a combined set of color toners for electrophotography for forming a multi-color image, in which the corresponding colors for electrophotography are combined; a color developing agent for electrophotography, which contains the color toners for electrophotography and can easily form a high-quality multi-color image; and a method and an apparatus for easily forming a high-quality color image by using the corresponding color toners for electrophotography.

What is claimed is:

1. A color toner for electrophotography comprising:

a coloring agent; and an infrared ray absorbent;

wherein the color toner for electrophotography exhibits contrast ratio of 35% to 95% and used in an extreme bottom layer of a multi-color image formed by laminating at least two types of toners selected from black toner, magenta toner, yellow toner, and cyan toner.

2. The color toner for electrophotography according to claim 1, wherein an average particle diameter of primary particles of the coloring agent is 100 nm or more.

3. The color toner for electrophotography according to claim 1, wherein the toner for elctrophotography is used for layers other than the extreme bottom layer of the multi-color image and contains the coloring agent and the infrared ray absorbent, and exhibits contrast ratio of 20% to 50%.

4. The color toner for electrophotography according to claim 3, wherein an average particle diameter of primary particles of the coloring agent is 200 nm or less.

5. The color toner for electrophotography according to claim 1, wherein a color tone difference ($\Delta E$) is 10 or less, when the color tone difference ($\Delta E$) is given as ($E_0$–$E_1$) between a color tone ($E_1$) in a case of containing an infrared ray absorbent and a color tone ($E_0$) in a case of not containing an infrared ray absorbent.

6. The color toner for electrophotography according to claim 1, further comprising a white coloring agent at a ratio of 10% or less by weight.

7. The color toner for electrophotography according to claim 1, wherein the color toner for electrophotography is used as a flash fixing toner.

8. A combined set of color toners for electrophotography comprising at least two types of toners selected from black toner, magenta toner, yellow toner, and cyan toner, and used for forming a multi-color image formed by laminating the two types of toners, wherein one of at least the two types of toners defined as toner A is used on an extreme bottom layer of the multi-color image and is selected from the magenta toner, yellow toner and cyan toner, and contains a coloring agent and an infrared ray absorbent, and exhibits contrast ratio of 35% to 95%, while the other of at least the two types of toners defined as toner B is used on layers other than the extreme bottom layer and contains a coloring agent and an infrared ray absorbent, and exhibits contrast ratio of 20% to 50%.

9. The combined set of color toners for electrophotography according to claim 8, wherein the toner A has a color tone difference ($\Delta E$) of 10 or less, when the color tone difference ($\Delta E$) is given as ($E_0$–$E_1$) between a color tone ($E_1$) in a case of containing an infrared ray absorbent and a color tone ($E_0$) in a case of not containing any infrared ray absorbent.

10. The combined set of color toners for electrophotography according to claim 8, wherein the toner B has color tone difference ($\Delta E$) of 10 or less, when the color tone difference ($\Delta E$) is given as ($E_0$–$E_1$) between a color tone ($E_1$) in a case of containing an infrared ray absorbent and a color tone ($E_0$) in a case of not containing any infrared ray absorbent.

11. The combined set of color toners for electrophotography according to claim 8, wherein at least one of the toner A and the toner B contains a white coloring agent at a ratio of 10% or less by weight.

12. A color developing agent for electrophotography comprising a color toner for electrophotography, wherein the color toner for electrophotography comprises a coloring agent and an infrared ray absorbent and exhibits contrast ratio of 35% to 95% and used in an extreme bottom layer of a multi-color image formed by laminating at least two types of toners selected from black toner, magenta toner, yellow toner, and cyan toner.

13. A method for forming color images comprising:

a step for forming an electrostatic latent image on an electrostatic latent image carrier;

a step for developing the electrostatic latent image by using a color toner for an extreme bottom layer and a color toner for an upper layer so as to form a visible image on the electrostatic latent image carrier;

a step for transferring the visible image on the electrostatic latent image carrier onto a recording medium for forming a combined transferred image which comprises a multiple layers, and an extreme bottom layer of the multiple layer is disposed on the recording medium; and a step for flash fixing the combined transferred image;

wherein the color toner for electrophotography comprises a coloring agent and an infrared ray absorbent and exhibits contrast ratio of 35% to 95% and used in an extreme bottom layer of a multi-color image formed by laminating at least two types of toners selected from black toner, magenta toner, yellow toner, and cyan toner.

14. The method for forming color images according to claim 13, wherein a light energy for the flash fixing is 3 to 7 J/cm$^2$.

15. An apparatus for forming color images comprising:

an electrostatic latent image carrier;

means for forming an electrostatic latent image on the electrostatic latent image carrier;

means for developing the electrostatic latent image using a color toner for electrophotography;

means for transferring the visible image onto a recording medium; and means for flash fixing the image transferred onto the recording medium;

wherein the color toner for electrophotography comprises a coloring agent and an infrared ray absorbent and exhibits contrast ratio of 35% to 95% and used in an extreme bottom layer of a multi-color image formed by laminating at least two types of toners selected from black toner, magenta toner, yellow toner, and cyan toner.

16. The apparatus for forming color images according to claim 15, wherein a light energy of the means for flash fixing is 3 to 7 J/cm$^2$.

17. An apparatus for forming color images comprising:

an electrostatic latent image carrier;

means for forming an electrostatic latent image on the electrostatic latent image carrier;

means for developing the electrostatic latent image using a color toner for an extreme bottom layer and a color toner for an upper layer so as to form a visible image on the electrostatic latent image carrier;

means for transferring the visible image on the electrostatic latent image carrier onto a recording medium for forming a combined transferred image which comprises a multiple layers, and an extreme bottom layer of the multiple layer is disposed on the recording medium; and means for flash fixing the combined transferred image on the recording medium;

wherein the color toner for electrophotography comprises a coloring agent and an infrared ray absorbent and exhibits contrast ratio of 35% to 95% and used in an extreme bottom layer of a multi-color image formed by laminating at least two types of toners selected from black toner, magenta toner, yellow toner, and cyan toner.

18. The apparatus for forming color images according to claim 17, wherein the color toner for the extreme bottom layer comprises a coloring agent and an infrared ray absorbent, and an average particle diameter of primary particles of the coloring agent is 100 nm or more.

19. The apparatus for forming color images according to claim 17, wherein the color toner for the upper layer comprises a coloring agent and an infrared ray absorbent, and exhibits a contrast ratio of 20% to 50%.

20. The apparatus for forming color images according to claim 17, wherein the color toner for the extreme bottom layer is deposited in an amount of 0.4 to 0.8 mg/cm$^2$ to form the extreme bottom layer of the multiple layers and the color toner for the upper layer is deposited in an amount of 0.4 to 0.8 mg/cm$^2$ to form a layer other than the extreme bottom layer of the multiple layers.

* * * * *